US005496671A

United States Patent [19]

Tamura et al.

[11] Patent Number: 5,496,671

[45] Date of Patent: Mar. 5, 1996

[54] ELECTROPHOTOGRAPHIC PHOTOCONDUCTOR

[75] Inventors: Hiroshi Tamura, Susono; Naoshi Mishima, Numazu; Yoshiaki Kawasaki, Shizuoka, all of Japan

[73] Assignee: Ricoh Company, Ltd., Tokyo, Japan

[21] Appl. No.: 325,093

[22] Filed: Oct. 17, 1994

Related U.S. Application Data

[63] Continuation of Ser. No. 10,868, Jan. 29, 1993, Pat. No. 5,411,827.

[30] Foreign Application Priority Data

Jan. 31, 1992 [JP] Japan ..... 4-041937

[51] Int. Cl.[6] ..... G03G 5/047

[52] U.S. Cl. ..... 430/58; 430/59

[58] Field of Search ..... 430/58, 59

[56] References Cited

U.S. PATENT DOCUMENTS 4,092,161 5/1978 Radler et al. ..... 430/58
4,983,482 1/1991 Ong et al. ..... 430/59
5,230,976 7/1993 Schank et al. ..... 430/59

FOREIGN PATENT DOCUMENTS 87966 4/1987 Japan ..... 430/59
66659 3/1989 Japan ..... 430/58

*Primary Examiner*—Roland Martin
*Attorney, Agent, or Firm*—Oblon, Spivak, McClelland, Maier & Neustadt

[57] ABSTRACT

An electrophotographic photoconductor composed of an electroconductive substrate, and a photoconductive layer consisting of a charge generation layer and a charge transport layer successively formed on the substrate in this order, the charge transport layer containing a carbon-carbon double-bond-containing charge transporting material, and a carbon-carbon double-bond-containing monomer or polymer, which serves as a binder resin, and readily reacts with the above-mentioned charge transporting material by the application of light or heat thereto.

10 Claims, 1 Drawing Sheet

ELECTROPHOTOGRAPHIC PHOTOCONDUCTOR

This is a continuation of application Ser. No. 08/010,868 filed on Jan. 29, 1993, now U.S. Pat. No. 5,411,827.

BACKGROUND OF THE INVENTION

1. Field of the Invention

The present invention relates to an electrophotographic photoconductor comprising an electroconductive substrate, and a photoconductive layer which comprises a charge generation layer and a charge transport layer successively formed on the substrate in this order.

2. Discussion of Background

Recently, organic photoconductors (OPC) are widely used in copying machines and printers. Such organic photoconductors comprise, for example, a substrate and a photoconductive layer. The photoconductive layer may comprise a charge generation layer (CGL) and a charge transport layer (CTL) which are successively overlaid on the substrate. The CTL is in the form of a film which comprises a low-molecular-weight charge transporting material which is dispersed in a binder resin in a certain concentration. The addition of the charge transporting material to the binder resin causes deterioration of the mechanical strength of the binder resin itself, and therefore, the CTL is fragile and has a low tensile strength. It is considered that the above-mentioned deterioration of the mechanical strength of the binder resin in the CTL causes some problems of the photoconductor, such as wear, flaw, peeling, and crack.

It is proposed to employ a high-molecular-weight material as the charge transporting material in the CTL. For instance, polymers such as polyvinylcarbazole, polyvinyl anthracene and polyvinyl pyrene reported by M. Stolka in J. POLYM. SCI. VOL. 21, 969; and a vinyl polymer of hydrazone described in '89 JAPAN HARD COPY p. 67 are proposed to use as charge transporting materials in the CTL. However, a film of the CTL is still fragile and sufficient mechanical strength cannot be obtained. In addition, the above-mentioned high-molecular-weight materials have shortcomings in the sensitivity and the mobility of hole in practice, which induces high residual potential and decreases the durability of a photoconductor.

To solve the aforementioned problems of the CTL, there is proposed a method for forming the CTL by previously dispersing a charge transporting material in a binder resin and then curing the binder resin. In this proposal, however, the content of the charge transporting material is as high as 30 to 50 wt. % in the CTL, so that a sufficient curing reaction is not carried out and the charge transporting material easily falls off from the binder resin. The problem of the wear of the photoconductor has not yet solved.

SUMMARY OF THE INVENTION

Accordingly, an object of the present invention is to provide an electrophotographic photoconductor with improved mechanical strength, and high photosensitivity and durability.

The above-mentioned object of the present invention can be achieved by an electrophotographic photoconductor comprising an electroconductive substrate, and a photoconductive layer which comprises a charge generation layer and a charge transport layer successively provided on the substrate in this order, the charge transport layer comprising a carbon-carbon double-bond-containing charge transporting material, and a carbon-carbon double-bond-containing monomer or polymer which reacts with the above charge transporting material by the application of light or heat thereto.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
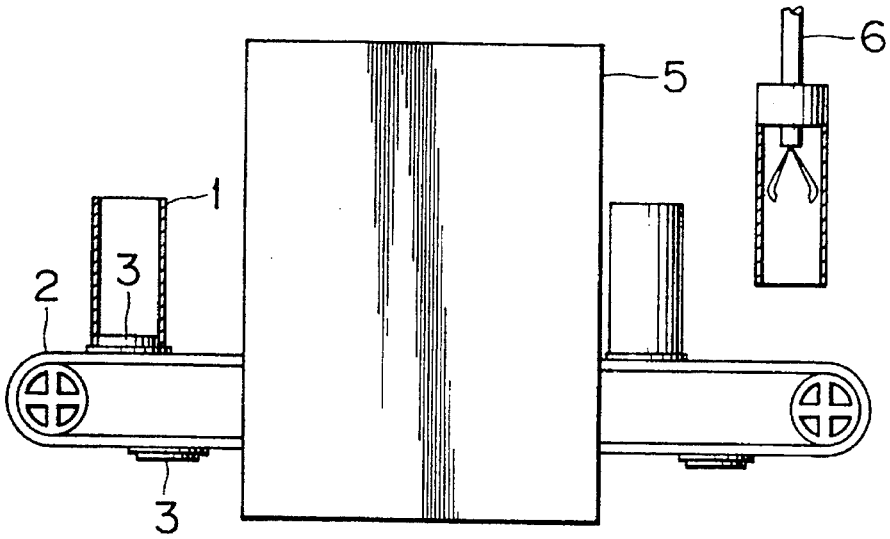
FIG. 1 is a schematic side view showing one embodiment of an apparatus for forming a charge transport layer of an electrophotographic photoconductor according to the present invention.

Because a coating liquid for forming a charge transport layer for use in an electrophotographic photoconductor of the present invention comprises (i) a carbon-carbon double-bond-containing charge transporting material (hereinafter referred to as CTM), (ii) a carbon-carbon double-bond-containing monomer or polymer which readily reacts with the above-mentioned CTM by the application of light or heat thereto, and (iii) a reaction initiator, a chain reaction between the CTM and the monomer or polymer readily proceeds when light or heat is applied to the above mentioned coating liquid, and a film of the charge transport layer with high hardness can be obtained.

A variety of carbon-carbon double-bond-containing compounds such as polyfunctional monomers having a vinyl group and polyfunctional acrylate can be employed as the monomers which readily react with the CTM by the application of light or heat thereto.

Examples of such a polyfunctional monomer with a vinyl group are esters of multivalent carboxylic acid and allyl alcohol, such as diallyl phthalate, diallyl isophthalate, diallyl malate, diallyl adipate, diallyl diglycolate, diethylene glycolbisallylcarbonate and triallyl trimellitate.

In the present invention, polyfunctional acrylate is preferably used as the aforementioned monomer. Specific examples of the polyfunctional acrylate include diethylene glycol diacrylate, diethylene glycol dimethacrylate, triethylene glycol diacrylate, polyethylene glycol diacrylate, polyethylene glycol dimethacrylate, polypropylene glycol dimethacrylate, butylene glycol diacrylate, butylene glycol dimethacrylate, neopentyl glycol diacrylate, neopentyl glycol dimethacrylate, 1,4-butanediol diacrylate, 1,6-hexanediol diacrylate, 1,6-hexanediol dimethacrylate, pentaerythritol diacrylate, pentaerythritol triacrylate, trimethylolpropane triacrylate, trimethylolpropane trimethacrylate, tetramethylolmethane tetraacrylate, and 2,2,5,5-tetrahydroxymethylcyclopentanone tetraacrylate. In addition to the above, bisphenol diglycidyl ether diacrylate compounds represented by the following formula I, which are obtained from a polyhydric phenol such as bisphenol A and glycidyl acrylate or glycidyl methacrylate; and bisphenol diacrylate compounds represented by the following formula II, which are obtained from bisphenol and acrylic acid, methacrylic acid, acryl chloride or methacryl chloride:

[Formula I]

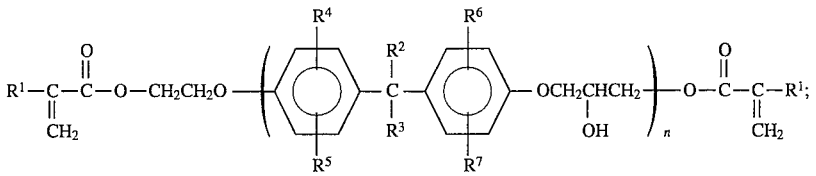

[Formula II]

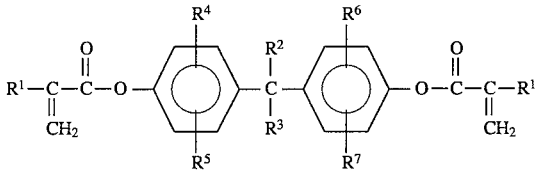

(wherein $R^1$ represents hydrogen or methyl group; $R^2$ and $R^3$ each represent hydrogen, an alkyl group having 1 to 10 carbon atoms, or an aryl group, which $R^2$ and $R^3$ may form a ring in combination; $R^4$, $R^5$, $R^6$ and $R^7$ each represent hydrogen, an alkyl group having 1 to 10 carbon atoms, an aryl group, or a halogen; and n is an integer of 1 to 50.)

The charge transport layer for use in the present invention can be obtained by mixing a carbon-carbon double-bond-containing charge transporting material, the previously mentioned carbon-carbon double-bond-containing monomer (M), which is reactive to the CTM, a reaction initiator, and a binder resin with a molecular weight of 8,000 to 100,000, such as an acrylic polymer, styrene polymer, acrylic-styrene copolymer, polyester, polycarbonate resin or epoxy resin, any of which have good film properties; and subsequently curing this mixture by the application of light or heat thereto.

Alternatively, a carbon-carbon double-bond-containing polymer (P) may be used instead of the above-mentioned monomer (M) in preparing the CTL for use in the present invention. In both cases, the carbon-carbon double-bond-containing monomer (M) or polymer (P) serves as a binder resin in the CTL.

The above-mentioned polymer (P) for use in the CTL may have the double bond of carbon atoms on the main chain, or the side chain thereof. For example, unsaturated polyester obtained from a condensation reaction between maleic anhydride or fumaric acid and polyhydric alcohol can be used as the polymer (P) having the double bond of carbon atoms on the main chain thereof. An ester of phthalic anhydride and glycidyl acrylate obtained by ring opening polymerization can be used as the polymer (P) having the double bond of carbon atoms on the side chain thereof, and polyester synthesized from acrylic acid, phthalic anhydride and propylene oxide can be used as the polymer (P) having the double bond of carbon atoms on the end thereof.

In addition to the above examples of the polymer (P) having the double bond of carbon atoms on the side chain thereof, polystyrene represented by the following general formula (III), and acrylic-allyl ester copolymer represented by the following general formula (IV) can be used in the present invention:

[Formula III]

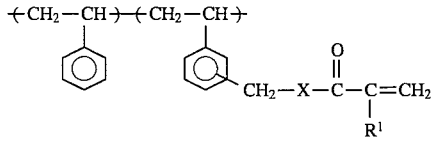

(wherein $R^1$ represents hydrogen or methyl group; and X represents —O— or —$CH_2O$—); and

[Formula IV]

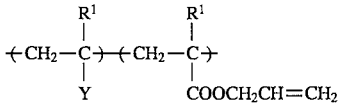

(wherein $R^1$ represents hydrogen or methyl group; and Y represents a phenyl group or —$COO(CH_2)_nH$, in which n is an integer of 1 to 10.)

Examples of the carbon-carbon double-bond-containing CTM for use in the present invention, which readily reacts with the previously mentioned monomer (M) or polymer (P) to form a cured film by the application of heat or light thereto are compounds of the following formulas:

[Formula V]

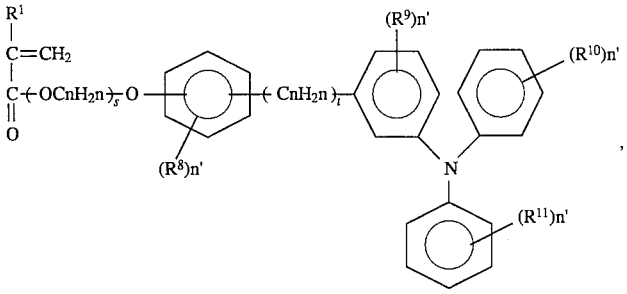

-continued

[Formula VI]

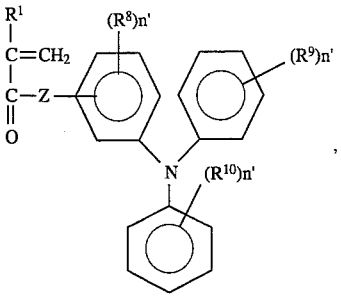

[Formula VII]

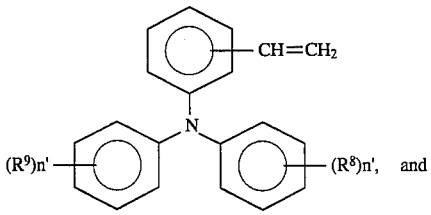

[Formula VIII]

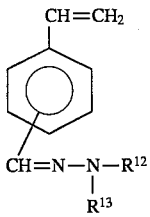

(wherein $R^1$ represents hydrogen or methyl group; $R^8$, $R^9$, $R^{10}$ and $R^{11}$, which may be the same or different, each represent hydrogen, a substituted or unsubstituted straight-chain or branched-chain alkyl group or alkoxyl group, a substituted or unsubstituted aryl group, an aryloxy group, an aralkyl group, a halogen, or a substituted or unsubstituted amino group; $R^{12}$ and $R^{13}$, which may be the same or different, each represent a substituted or unsubstituted straight-chain or branched-chain alkyl group, a substituted or unsubstituted aryl group, or a substituted or unsubstituted amino group, and $R^{12}$ and $R^{13}$ may form a ring in combination; Z represents —O—, —$OC_nH_{2n}$— or —$OC_nH_{2n}O$—; n is an integer of 1 to 10; n is an integer of 1 to 5; s is 0 or 1; and t is 0 or 1.)

Specific examples of the compound represented by the previously mentioned formula V are as follows:

No. 1

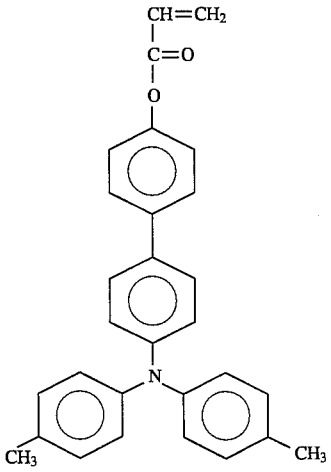

-continued

No. 2

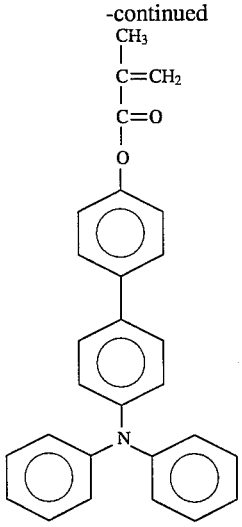

-continued
No. 3
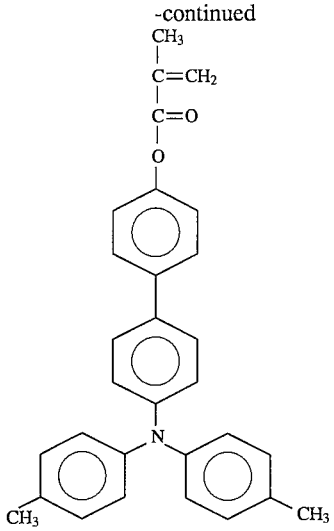
No. 4
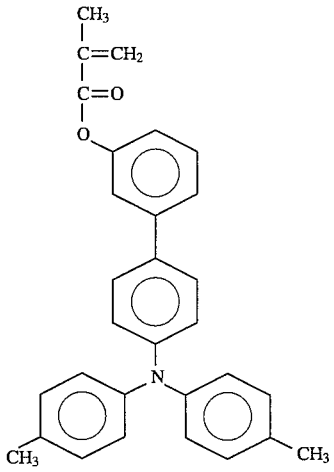
No. 5
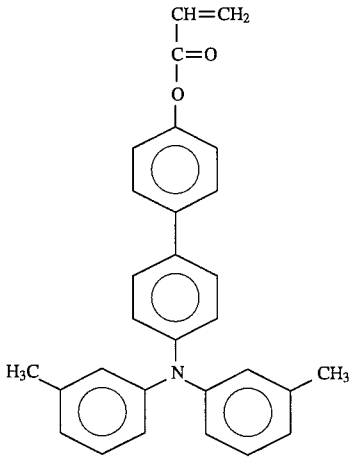
-continued
No. 6
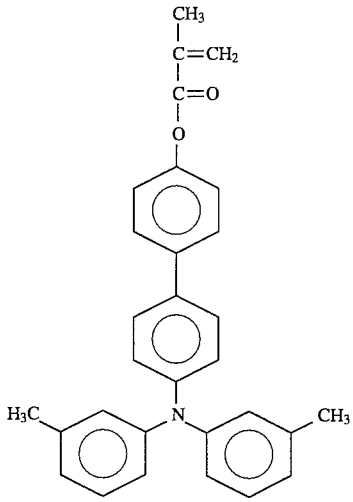
No. 7
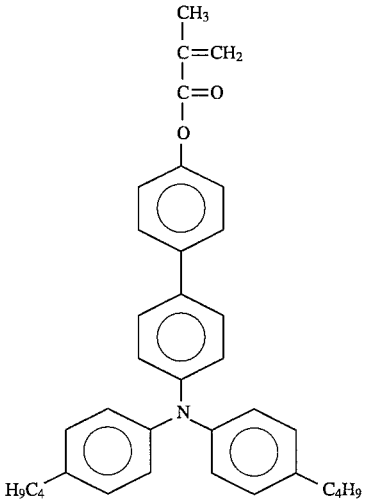
No. 8
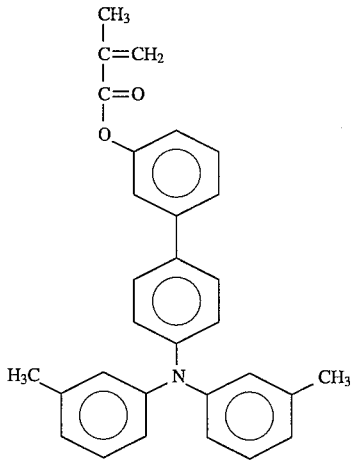

-continued
No. 9
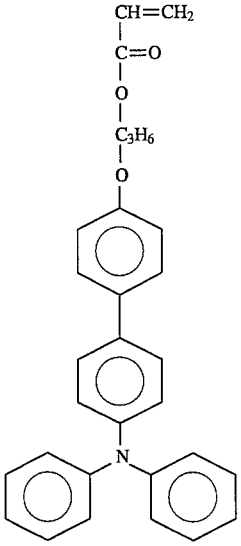
No. 10
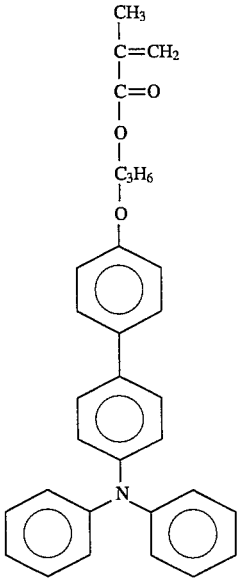
No. 11
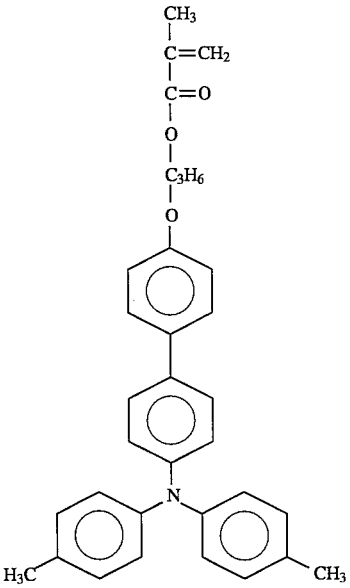
-continued
No. 12
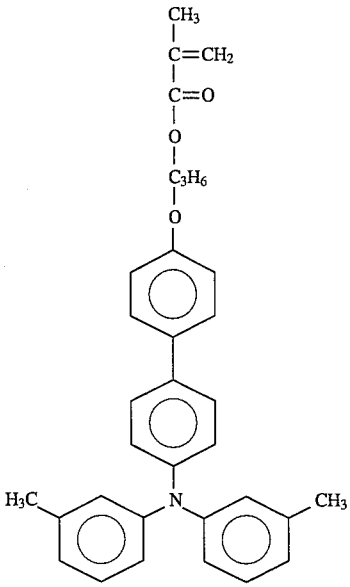
No. 13
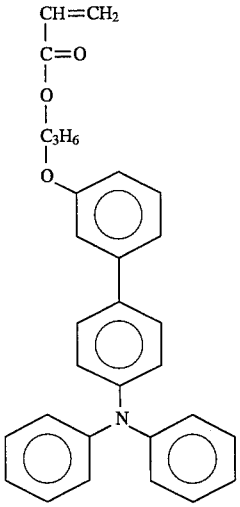
No. 14
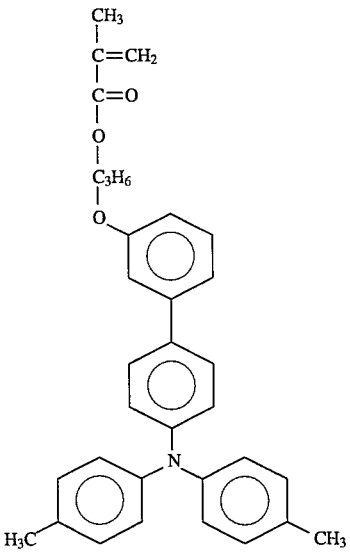

-continued
No. 15
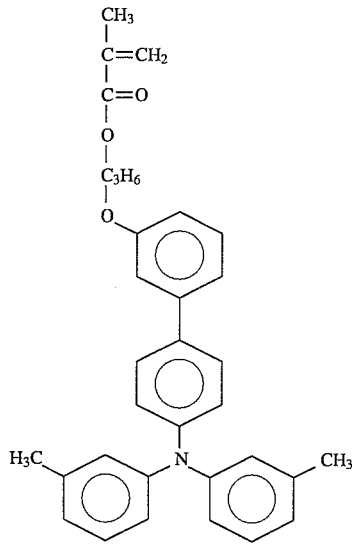
No. 16
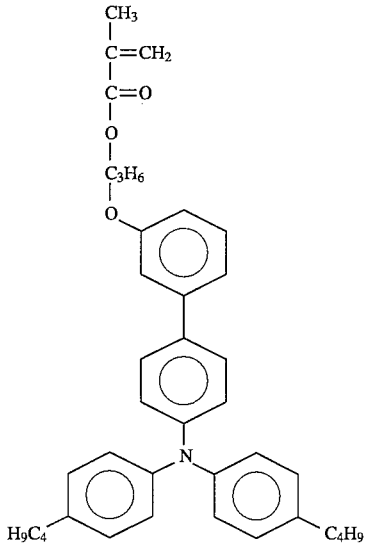
No. 17
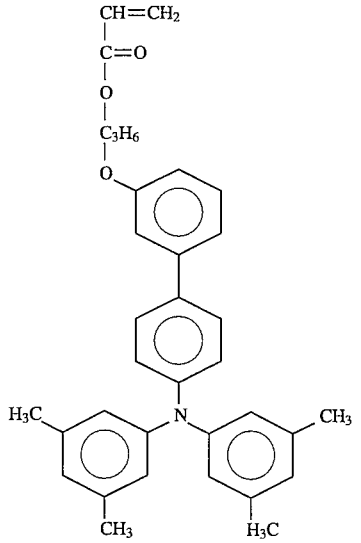
-continued
No. 18
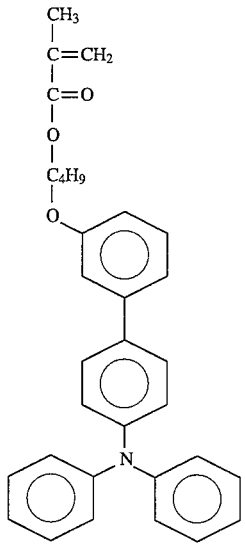
No. 19
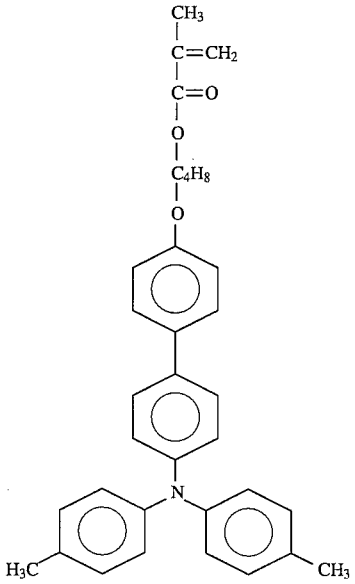
No. 20
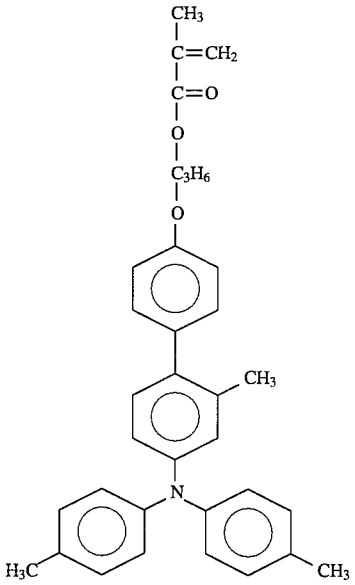

No. 21
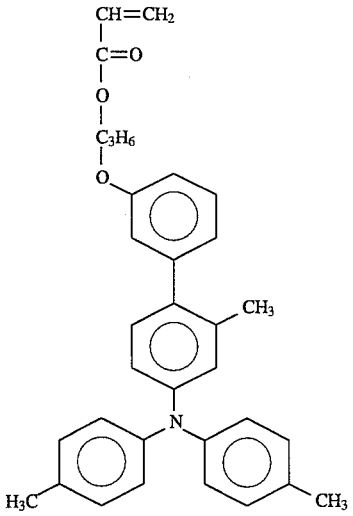
No. 22
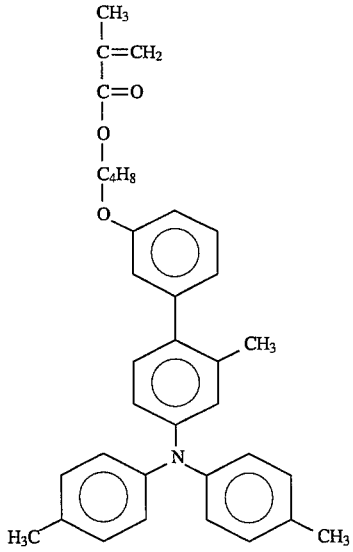
No. 23
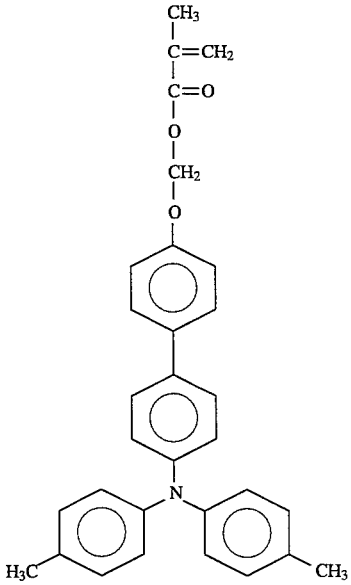
No. 24
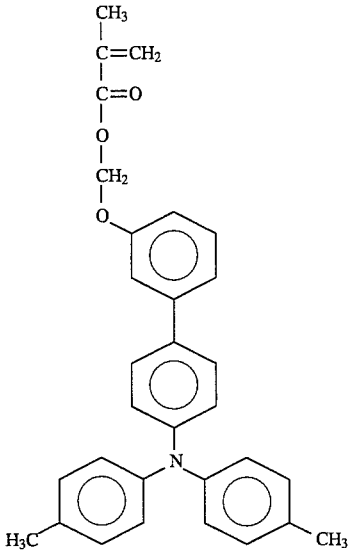
No. 25
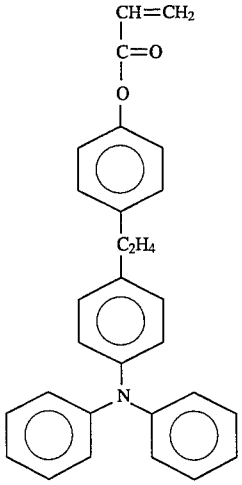
No. 26
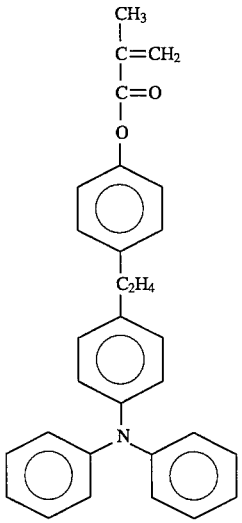

-continued
No. 27
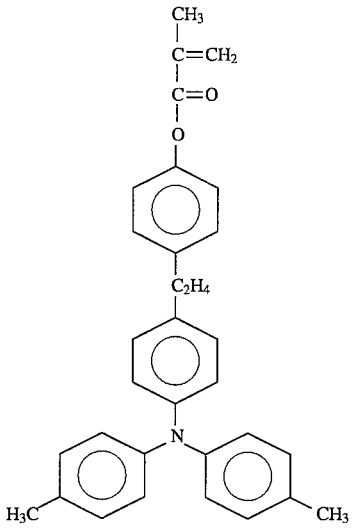
No. 28
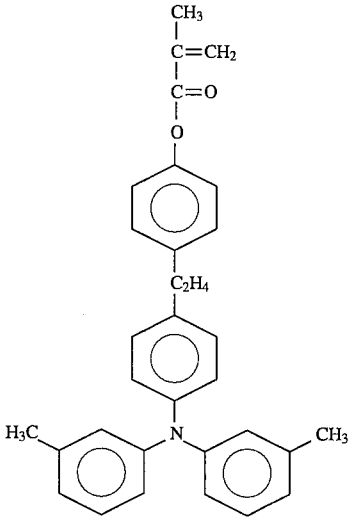
No. 29
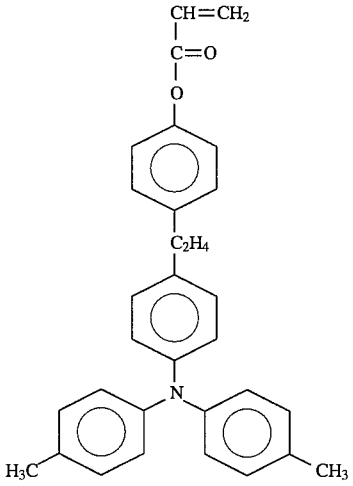
-continued
No. 30
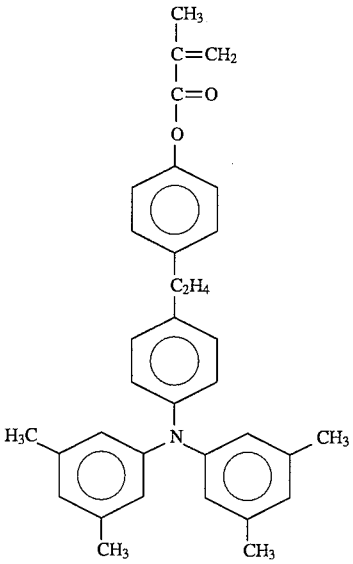
No. 31
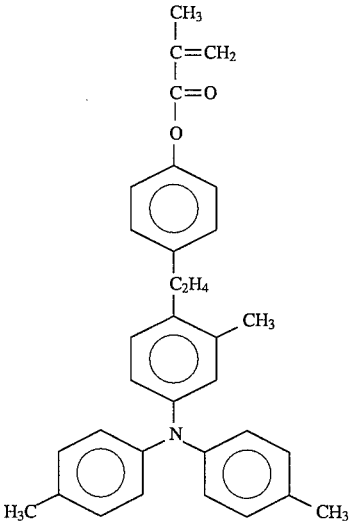
No. 32
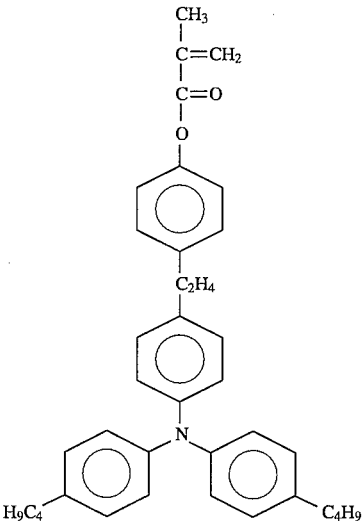

-continued
No. 33
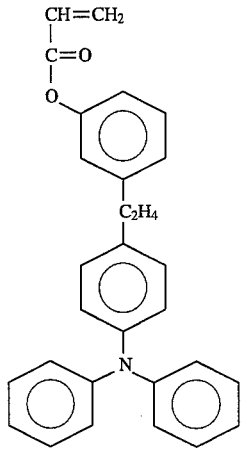
No. 34
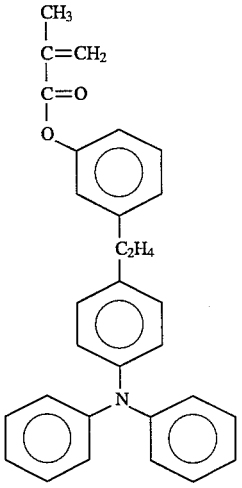
No. 35
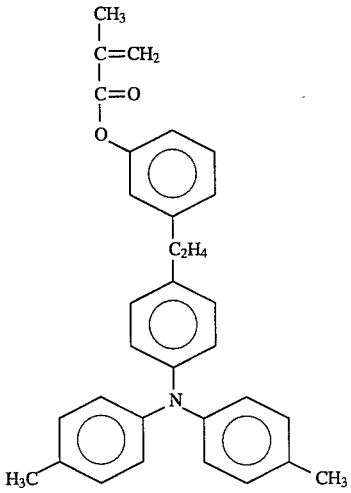
-continued
No. 36
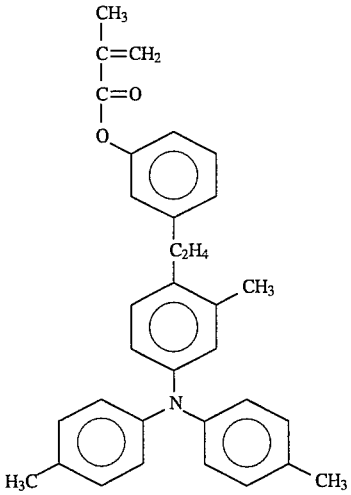
No. 37
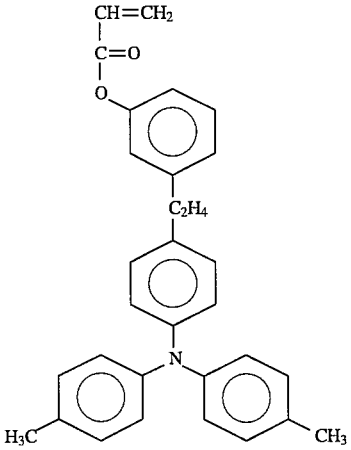
No. 38
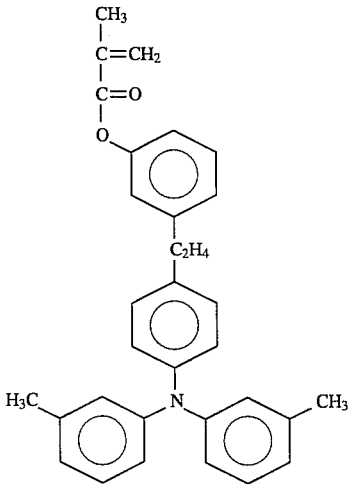

-continued
No. 39
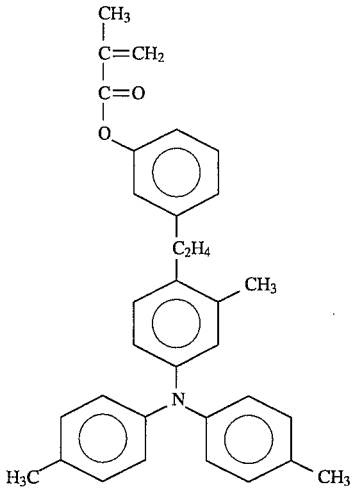
No. 40
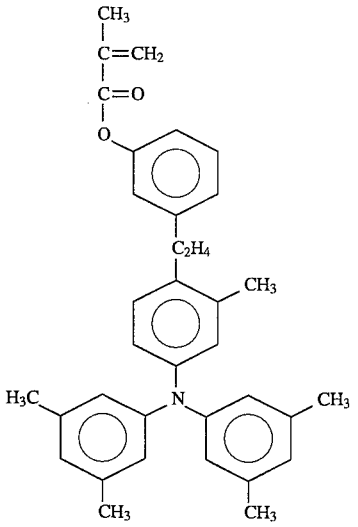
No. 41
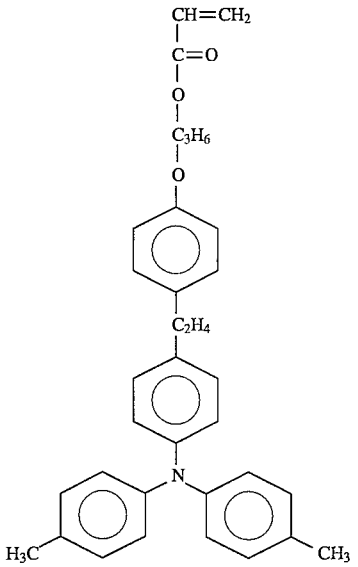
-continued
No. 42
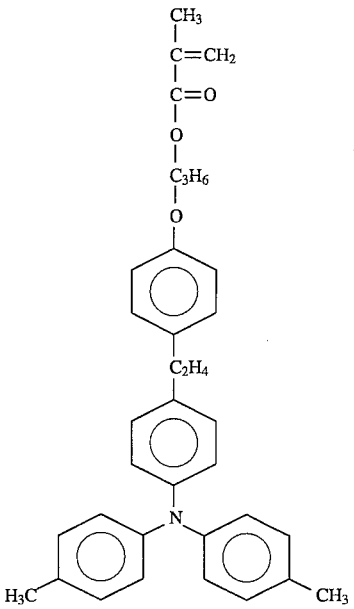
No. 43
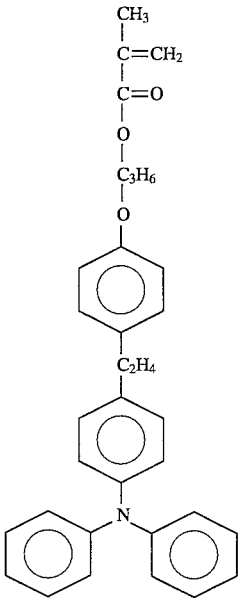

-continued
No. 44
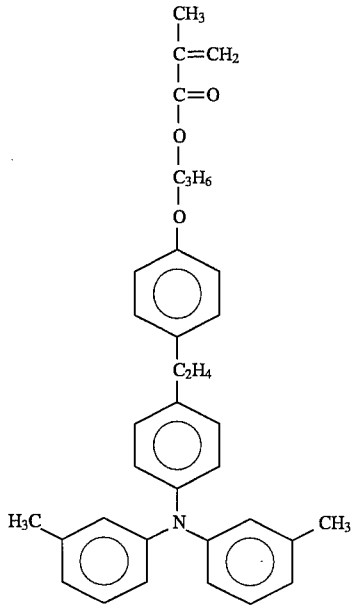
No. 45
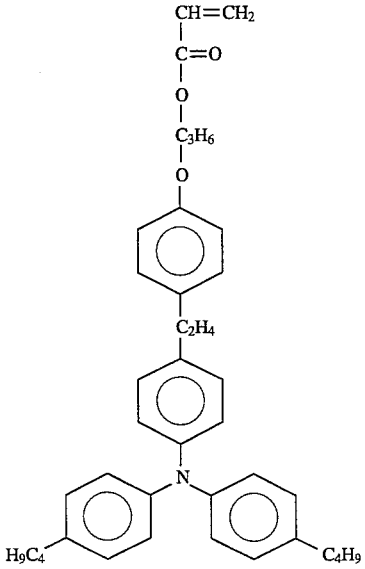
-continued
No. 46
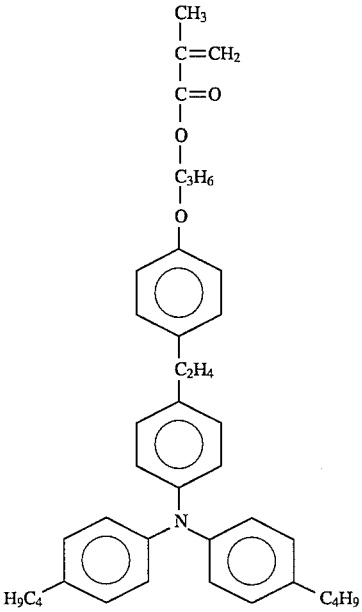
No. 47
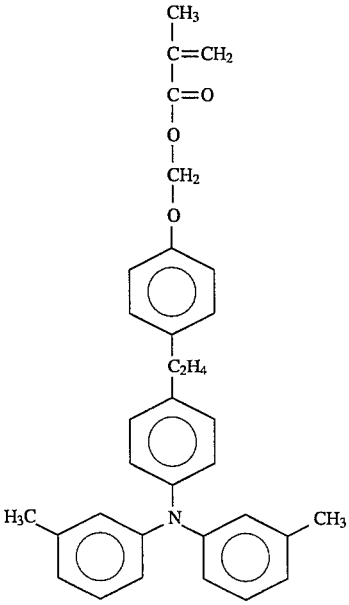

-continued
No. 48
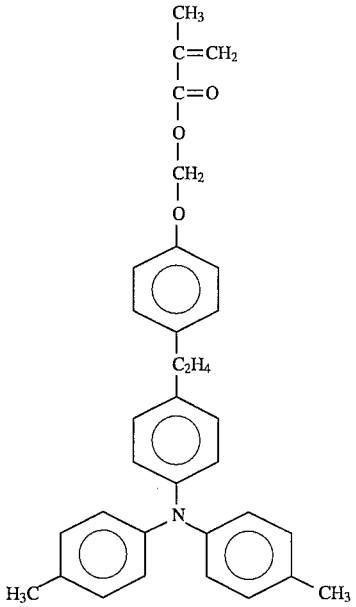
No. 49
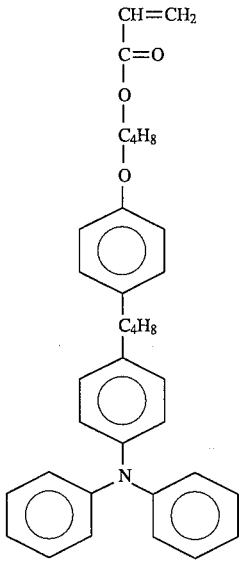
-continued
No. 50
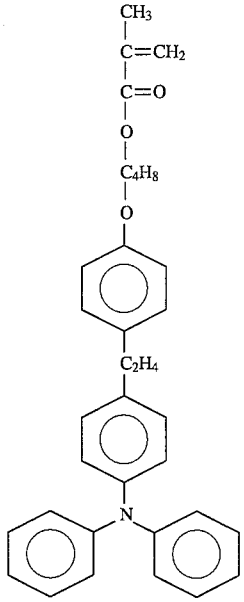
No. 51
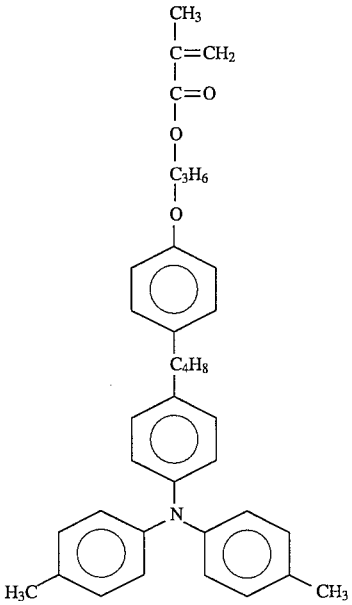

-continued
No. 52
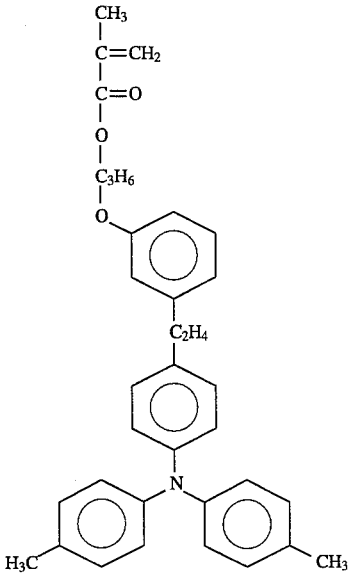
No. 53
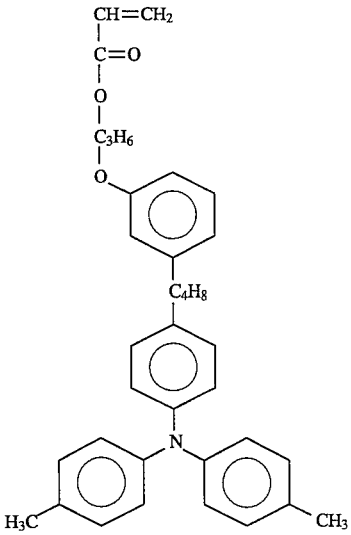
No. 54
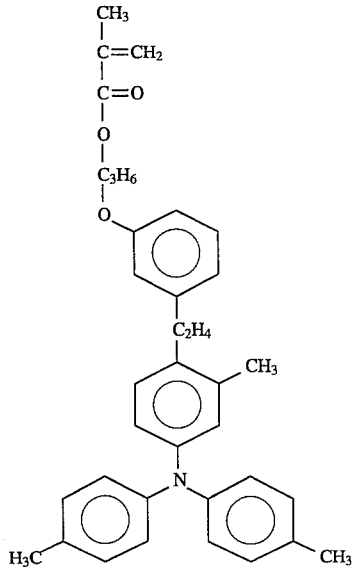
-continued
No. 55
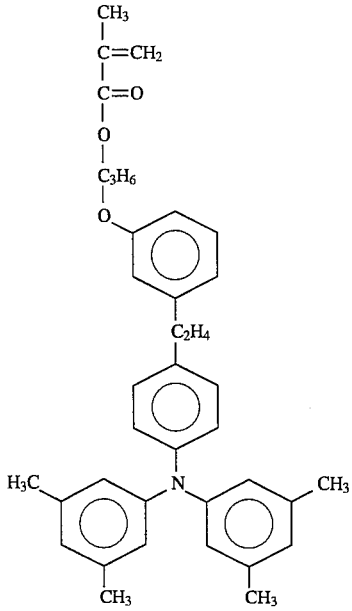
No. 56
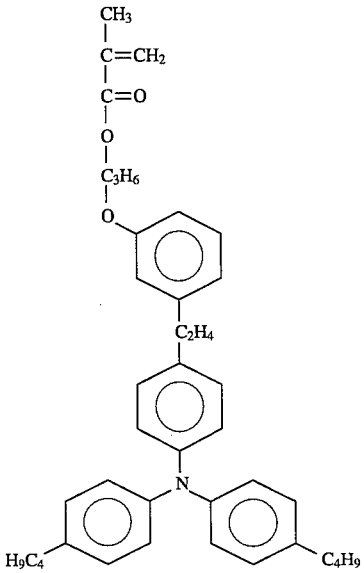
No. 57
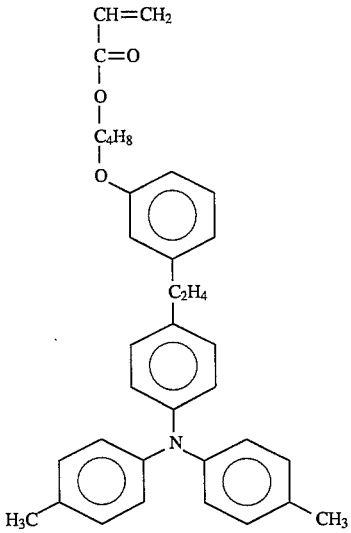

-continued
No. 58
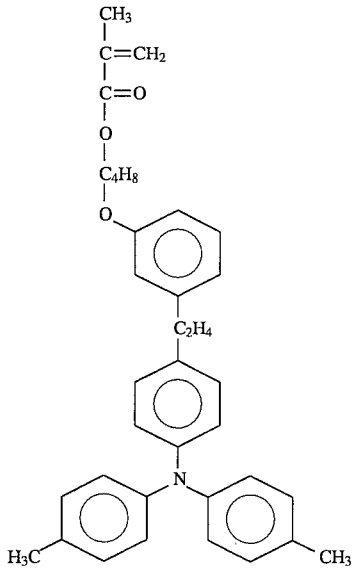
No. 59
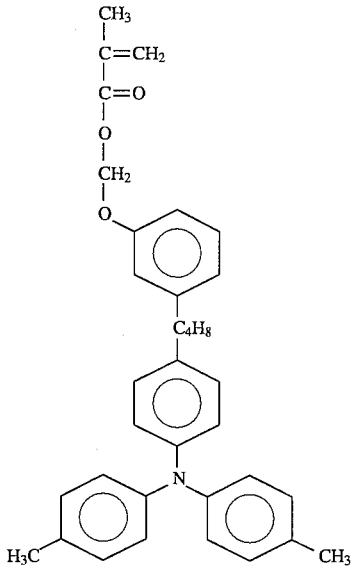
No. 60
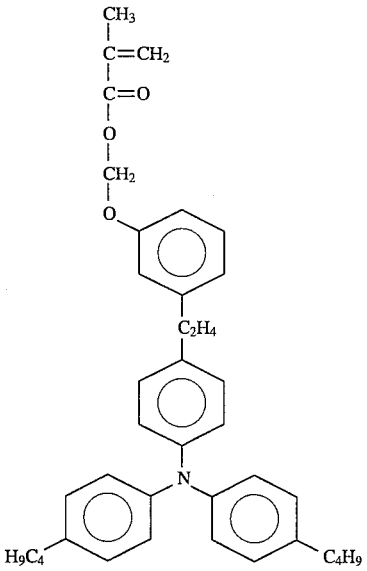
Specific examples of the compound represented by the previously mentioned formula VI are as follows:
No. 61
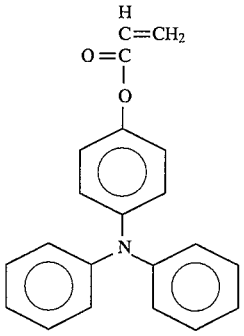
No. 62
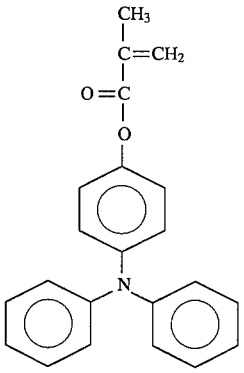
No. 63
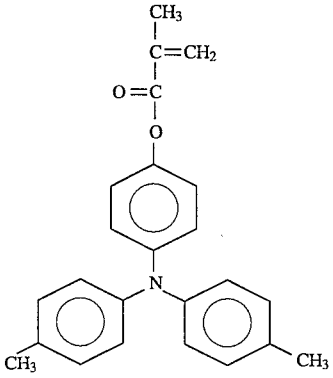
No. 64
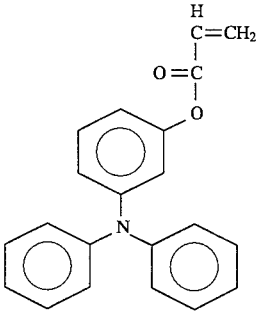

-continued
No. 65
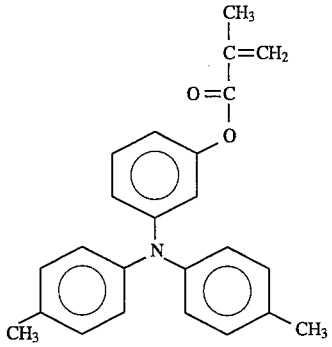
No. 66
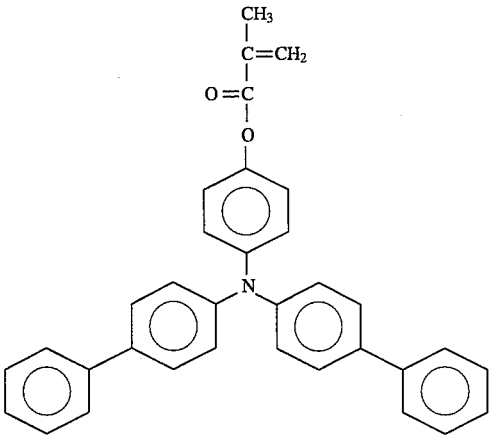
No. 67
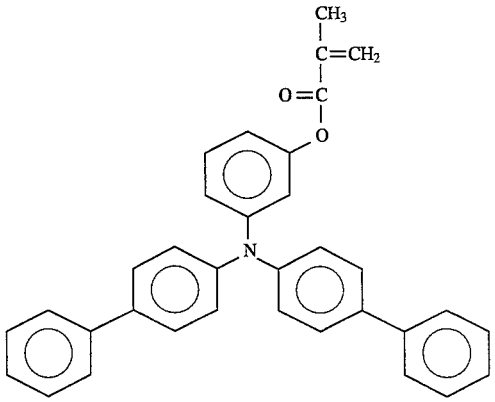
No. 68
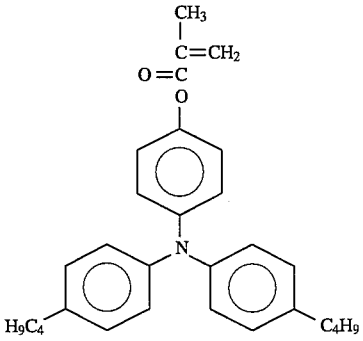
-continued
No 69
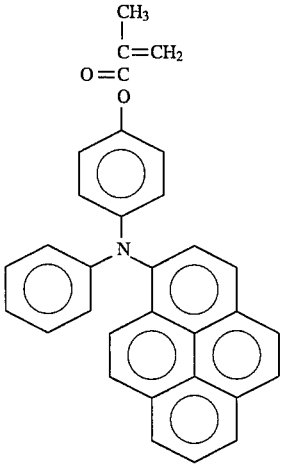
No. 70
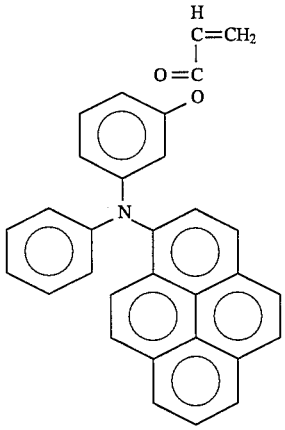
No. 71
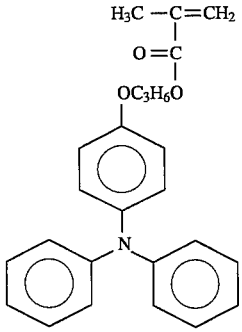
No. 72
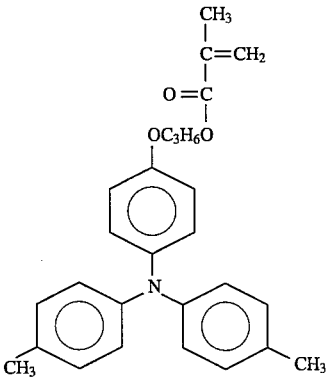

-continued
No. 73
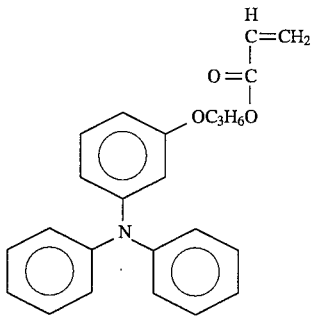
No. 74
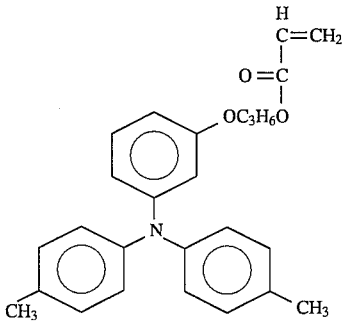
No. 75
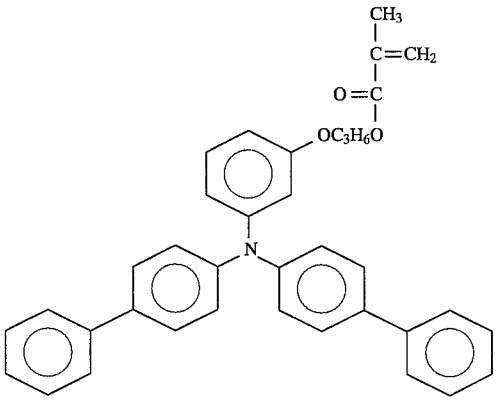
No. 76
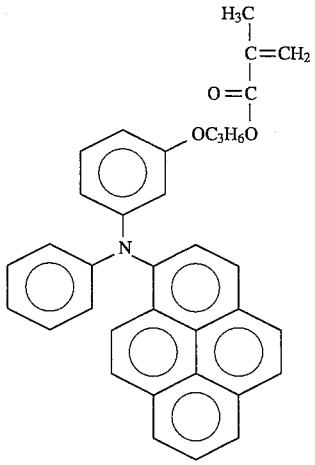
-continued
No. 77
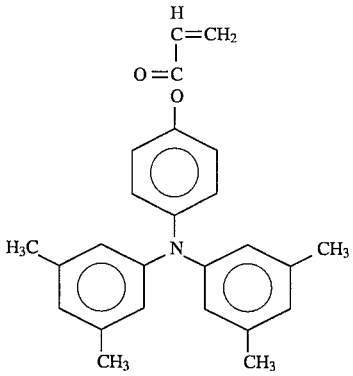
No. 78
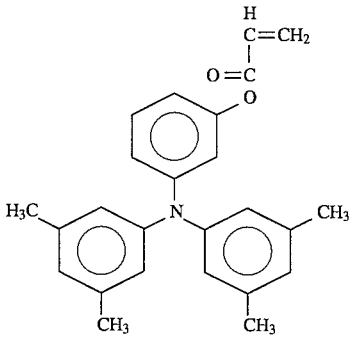
No. 79
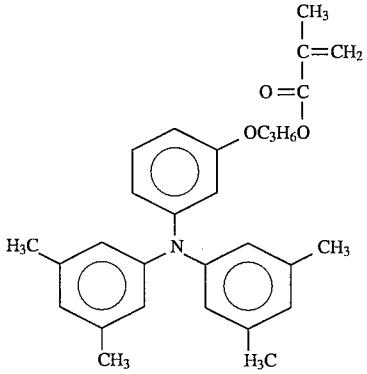
No. 80
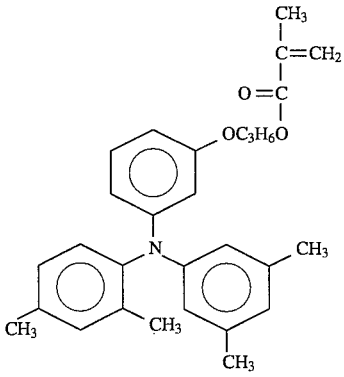

-continued
No. 81
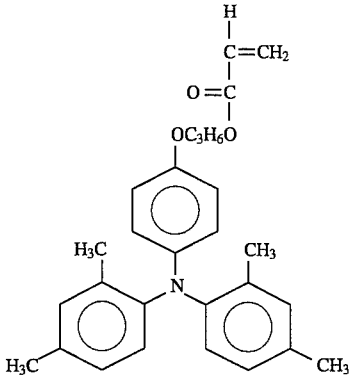
No. 82
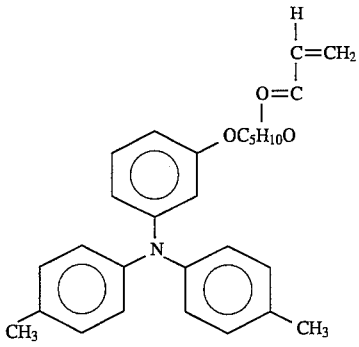
No. 83
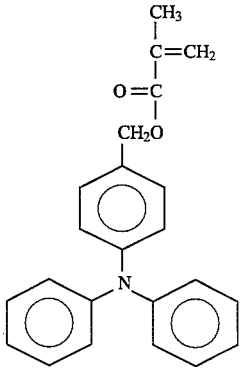
No. 84
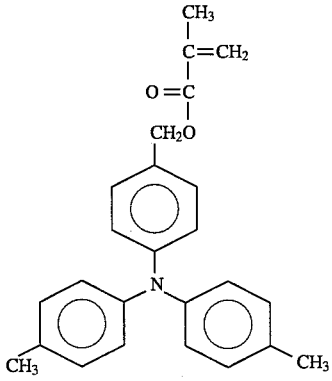
-continued
No. 85
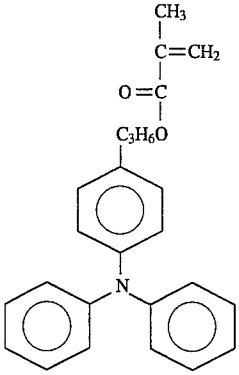
No. 86
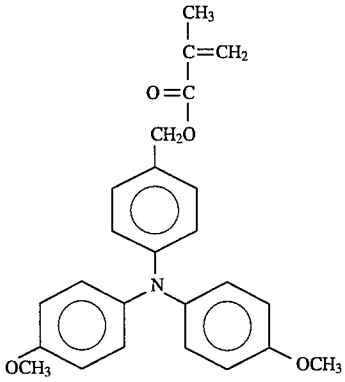
No. 87
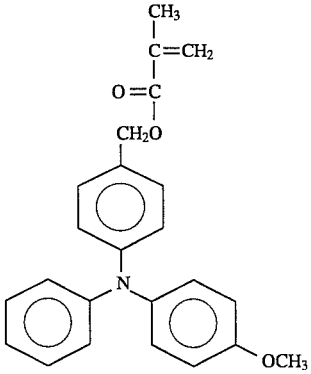
No. 88
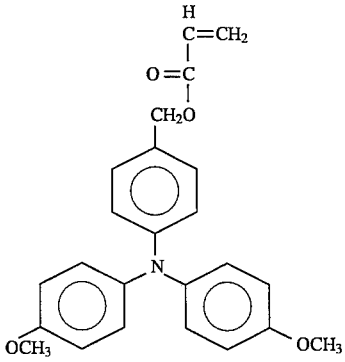

-continued
No. 89
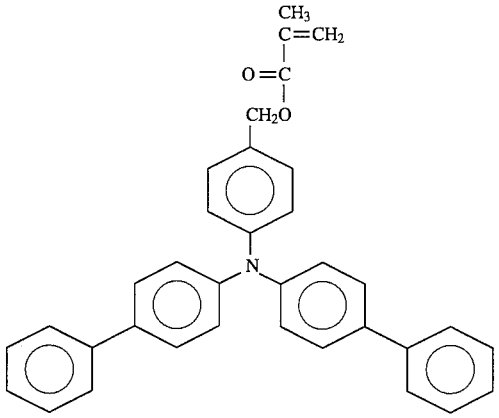
No. 90
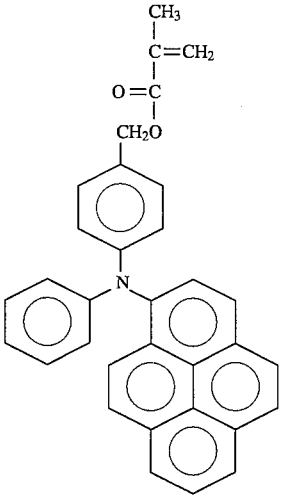
No. 91
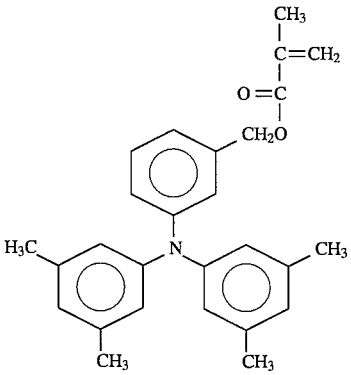
No. 92
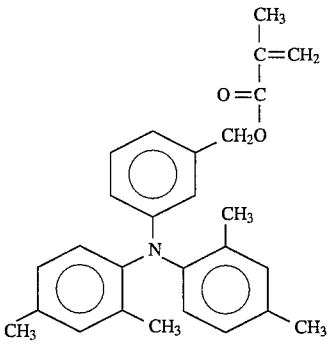
-continued
No. 93
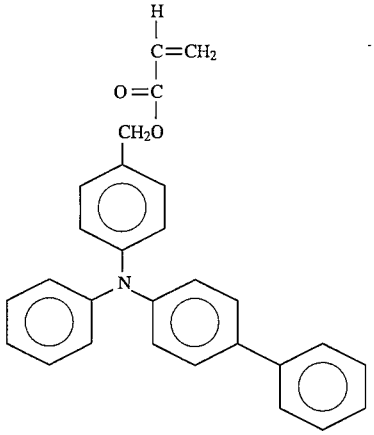
Specific examples of the compound represented by the previously mentioned formula VII are as follows:
No. 94
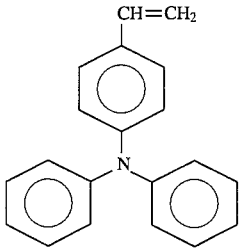
No. 95
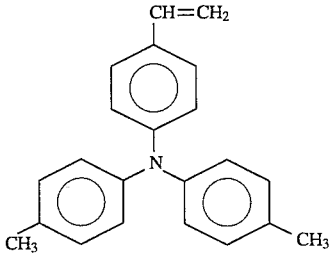
No. 96
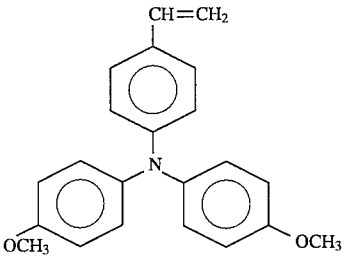
No. 97
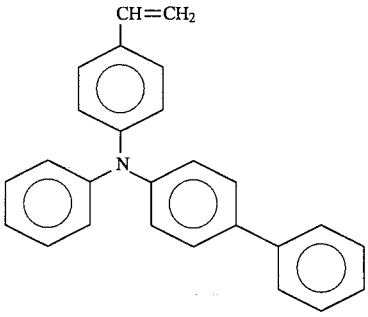

-continued
No. 98
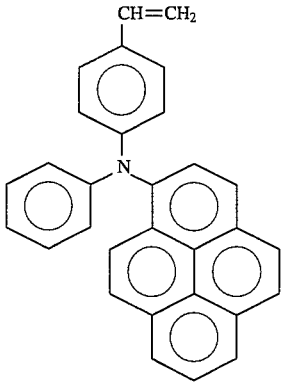
No. 99
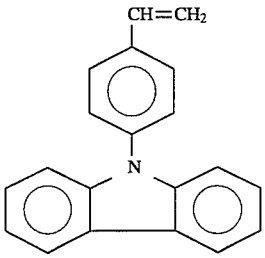
No. 100
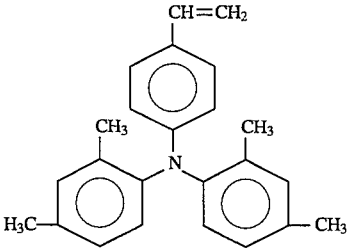
Specific examples of the compound represented by the previously mentioned formula VIII are as follows:
No. 101
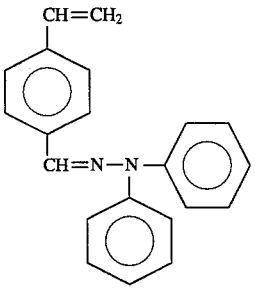
No. 102
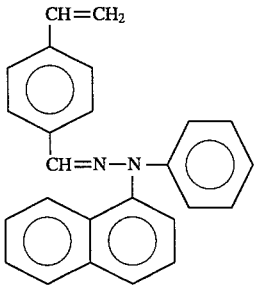
-continued
No. 103
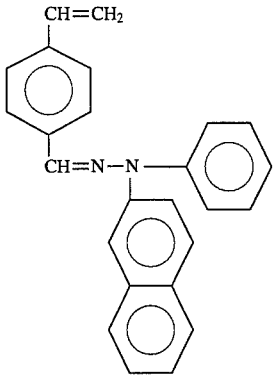
No. 104
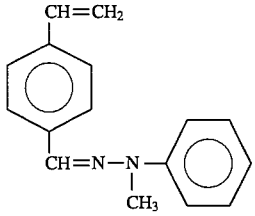
No. 105
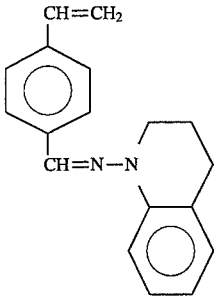
No. 106
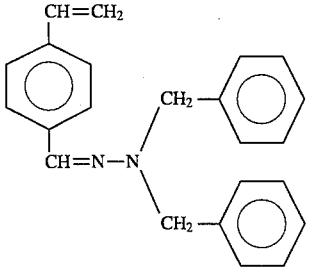
No. 107
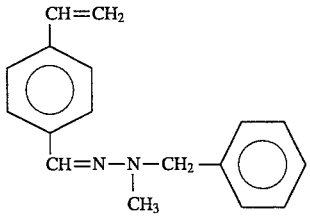
No. 108
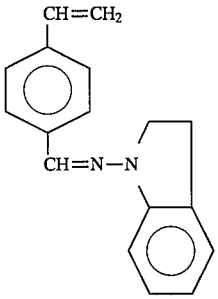

-continued

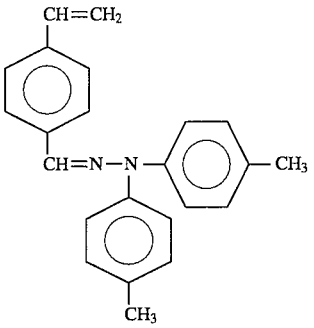

No. 109

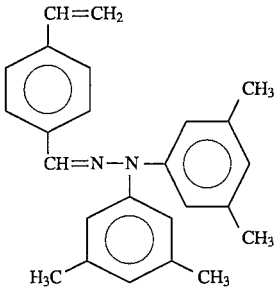

No. 110

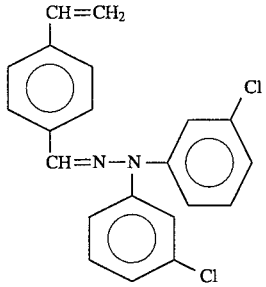

No. 111

In the case where the CTL of the electrophotographic photoconductor according to the present invention comprises the CTM and the polymer (P), it is preferable that the mixing ratio by weight of the CTM to the polymer (P) be in the range of (1 to 60):10, and more preferably (5 to 50):10. When the mixing ratio is within the above range, not only the ionization potential and the mobility of the CTM are satisfactory, but also the electric characteristics and the photosensitivity of the obtained photoconductor do not decrease and the residual potential does not increase. In addition, the hardness of the obtained CTL is increased, and at the same time, fragility of the film of the CTL can be improved because no crystallization of the CTM occurs in the CTL. Therefore, the impact resistance of the CTL can be increased, thereby preventing the CTL from peeling.

When the CTL comprises the CTM and the carbon-carbon double-bond-containing monomer (M), a resin which may be inert or not may be further added as a binder resin. In this case, the amount ratio by weight of the CTM/monomer/resin is preferably (1 to 60)/(5 to 20)/10, and more preferably (5 to 50)/(5 to 15)/10. When the above-mentioned mixing ratio is satisfied, not only the photosensitivity of the photoconductor does not deteriorate, but also the mechanical strength of the CTL does not decrease.

It is preferable to add a reaction initiator to the CTM and the monomer (M) or polymer (P) in the present invention. Examples of the reaction initiator for use in the present invention include a peroxide such as 2,5-dimethylhexane, 2,5-dihydroperoxide, dicumyl peroxide, benzoyl peroxide, t-butylcumyl peroxide, and 2,5-dimethyl-2,5-di(peroxybenzoyl)hexyne- 3; and an azo compound such as azobisisobutyronitrile. As a photo-setting initiator, a ketone compound such as Michler's ketone, benzoin isopropyl ether, or 1-hydroxycyclohexylphenylketone can be used. It is preferable that the amount of the above-mentioned reaction initiator be about 0.005 to 0.5 parts by weight to one part by weight of the CTM in preparing a coating liquid for the CTL.

A mixture of the previously mentioned CTM, the monomer (M) or polymer (P) and the reaction initiator, and the binder resin when necessary is dissolved in an appropriate solvent in a concentration of 10 to 70% to prepare a coating liquid for forming the CTL of the photoconductor according to the present invention. The coating liquid thus obtained is coated by the dip coating, spray coating and roll coating methods.

Examples of the above-mentioned solvent are alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propyl ether; halogen-containing solvents such as dichloromethane, dichloroethane, trichloroethane and chlorobenzene; aromatic solvents such as benzene, toluene and xylene; and cellosolve such as methyl cellosolve, ethyl cellosolve and cellosolve acetate.

In the present invention, a charge transporting material conventionally used in the CTL may be used in combination with the previously mentioned carbon-carbon double-bond-containing CTM.

Examples of the conventional charge transporting material are as follows: oxazole derivatives and oxadiazole derivatives (Japanese Laid-Open Patent Application 52-139065, and Japanese Patent Publication 52-139066); benzidine derivatives (Japanese Laid-Open Patent Application 58-32372); α-phenylstilbene derivatives (Japanese Laid-Open Patent Application 57-73075); hydrazone derivatives (Japanese Laid-Open Patent Applications 55-154955, 55-156954, 55-52063, and 56-81850); triphenylmethane derivatives (Japanese Patent Publication 51-10983); anthracene derivatives (Japanese Patent Publication 51-94829); styryl derivatives (Japanese Laid-Open Patent Applications 56-29245 and 58-198043); carbazole derivatives (Japanese Laid-Open Patent Application 58-58552); and pyrene derivatives (Japanese Laid-Open Patent Application 2-94812). The proper thickness of the CTL is 10 to 50 μm, preferably 15 to 30 μm.

The photoconductive layer of the photoconductor according to the present invention comprises a charge generation layer (CGL) and the charge transport layer (CTL) formed on the CGL.

The charge generation layer (CGL) comprises a charge generating material (CGM) and a binder resin when necessary. The proper thickness of the CGL is 0.02 to 3 μm, preferably 0.05 to 1 μm.

As the charge generating material for use in the present invention, C.I. Pigment Blue 25 (C.I. No. 21180), C.I. Pigment Red 41 (C.I. No. 21200), C.I. Acid Red 52 (C.I. No. 45100), C.I. Basic Red 3 (C.I. No. 45210), a phthalocyanine pigment having a porphyrin skeleton, an azulenium salt pigment, a squaric salt pigment, and an azo pigment having a carbazole skeleton (Japanese Laid-Open Patent Application 53-95033), an azo pigment having a stilbene skeleton (Japanese Laid-Open Patent Application 53-138229), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-17734), a trisazo pigment having a carbazole skeleton (Japanese Laid-open Patent Applications 57-195767 and 57-195768), an azo pigment having an anthraquinone skeleton (Japanese Laid-Open Patent Application 57-202545); a condensed polycyclic quinone compound such as Vat Orange 3 (C.I. No. 59300); a perylene compound (C.I. No. 38001), selenium and alloys thereof and s-silicon (amorphous silicon) can be employed.

These charge generating materials are pulverized and dispersed in an appropriate solvent in a ball mill and an attritor. Examples of the solvent are cyclohexanone, methyl ethyl ketone, tetrahydrofuran, dioxane, butyl acetate, toluene, and cellosolve. It is preferable that the average particle diameter of the charge generating material be 0.5 μm or less. When the charge generating material is used in combination with the binder resin in preparing the CGL, resins such as polyvinyl butyral, ethyl cellulose, epoxy resin, polycarbonate, polyester, polymethyl methacrylate, and polyurethane resin can be employed as the binder resins. In this case, is is preferable that the mixing ratio by weight of the charge generating material to the binder resin be 100:(1 to 200), and more preferably 100:(20 to 100). The charge generating material is coated on the electroconductive substrate so as to have the above-mentioned thickness by the dip coating, spray coating, or roll coating method. In addition, selenium, alloys thereof and α-silicon can be coated on the substrate by vacuum deposition, chemical vapor deposition (CVD), and sputtering.

The electroconductive substrate of the photoconductor according to the present invention can be prepared by coating a plastic film or a sheet of paper, which may be in the cylindrical form, with a metal such as aluminum, alloys thereof, nickel, chromium, nichrome or copper, or a metallic oxide such as tin oxide or indium oxide by the vacuum deposition or sputtering method. Alternatively, a sheet of aluminum, alloys thereof, nickel or stainless steel may be formed into a tube by the drawing and ironing (D.I.) method, the impact ironing (I.I.) method, the extrusion method or the pultrusion method. Subsequently, the tube thus obtained may be subjected to surface treatment such as machining or abrasion to prepare the electroconductive substrate for use in the photoconductor of the present invention.

After the formation of the electroconductive substrate, an intermediate layer may be provided on the substrate for improving the adhesion between the substrate and the photoconductive layer and preventing the injection of electric charge. The intermediate layer for use in the present invention comprises a resin such as polyamide, polyurethane, silicone resin, phenolic resin, polyvinyl alcohol, polyvinyl butyral, polyacrylanilide or vinyl chloride—vinyl acetate—maleic acid copolymer. In addition, particles of a pigment such as $SiO_2$, $Al_2O_3$, ZnO, $TiO_2$, ZnS, or $ZrO_2$ may be dispersed in the above-mentioned resin in the intermediate layer. It is preferable that the thickness of the intermediate layer be 0.05 to 20 μm, and more preferably 0.1 to 10 μm.

Other features of this invention will become apparent in the course of the following description of exemplary embodiments, which are given for illustration of the invention and are not intended to be limiting thereof.

Synthesis Example 1

[Synthesis of carbon-carbon double-bond-containing polymer]

A mixture of the following components was placed in a four-necked flask:

| | Parts by Weight |
|---|---|
| Methyl methacrylate | 50 |
| n-butyl methacrylate | 30 |
| Azobisisobutyronitrile | 2 |
| Toluene | 190 |

Nitrogen was bubbled through the above mixture for 30 minutes at room temperature, and the temperature of the mixture was gradually raised to 70° C. The reaction was first carried out at 72°±3° C. for 5 hours, and then, at 90° C. for 2 hours. Thus, an acrylic copolymer was obtained. The average molecular weight of this copolymer was 25,000 in accordance with gas permeation chromatography (GPC).

Synthesis Examples 2 to 4

The procedure for synthesizing the polymer in Synthesis Example 1 was repeated except that the formulation for the polymer employed in Synthesis Example 1 was changed as shown in Table 1, so that acrylic copolymers were obtained. The average molecular weight of each copolymer synthesized in Synthesis Examples 2 to 4 is also shown in Table 1.

TABLE 1

| | Formulation of Polymer | | Average Molecular |
|---|---|---|---|
| Synthesis Example | Monomers | Parts by weight | Weight of Polymer |
| 2 | MMA—St—nBMA | 20:30:30 | 15,000 |
| 3 | St—2EHMA | 50:30 | 10,500 |
| 4 | St—nBMA—AlMA | 50:25:5 | 12,000 |

MMA: methylmethacrylate, St: styrene, nBMA: butyl methacrylate
2EHMA: 2-ethylhexyl methacrylate, AlMA: allyl methacrylate

EXAMPLE 1

[Formation of Intermediate Layer]

A polyamide resin (Trademark "CM-8000", made by Toray Industries, Inc.) was coated on an aluminum sheet with a thickness of 0.3 mm serving as an electroconductive substrate by a doctor blade, and dried, so that an intermediate layer with a thickness of 0.3 μm was formed on the substrate.

[Formation of Charge Generation Layer]

A dispersion obtained by pulverizing and dispersing an azo pigment of formula (IX) in cyclohexanone was coated on the above prepared intermediate layer by a doctor blade, and dried, so that a charge generation layer with a thickness of 0.2 μm was formed on the intermediate layer.

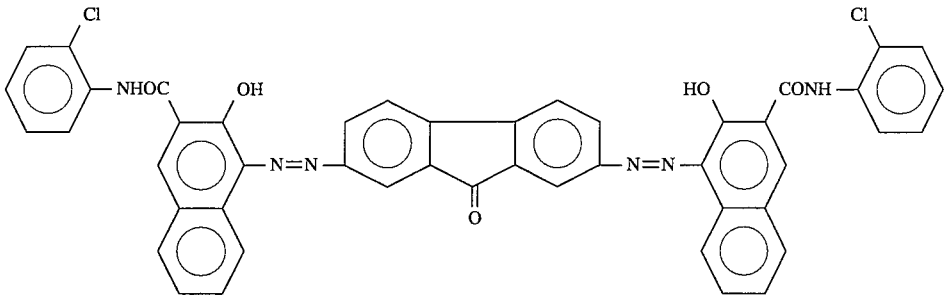

(IX)

[Formation of Charge Transport Layer]

20 parts by weight of the acrylic resin synthesized in Synthesis Example 1 with a solid content of 30 wt. %, 4 parts by weight of 1,6-hexanediol dimethacrylate, 9 parts by weight of the CTM No. 3, 0.1 parts by weight of Michler's ketone and 30 parts by weight of toluene were mixed to prepare a coating liquid for a charge transport layer. The thus prepared liquid was coated on the above prepared charge generation layer, and dried at 120° C. for 20 minutes. The coated surface was then subjected to photo-setting by use of a commercially available photo-setting apparatus "UVC-2534" (Trademark), made by Ushio Inc., under the following conditions:

Illuminance of mercury vapor lamp: 120 W/cm

Distance between the coated surface and the mercury vapor lamp: 8 cm

Moving speed of photoconductive drum: 1 m/min.

Thus, a charge transport layer with a thickness of 23 μm was formed on the charge generation layer, and an electrophotographic photoconductor of the present invention was obtained.

EXAMPLE 2

An intermediate layer and a charge generation layer were successively formed on a substrate in the same manner as in Example 1.

[Formation of Charge Transport Layer]

20 parts by weight of the acrylic resin synthesized in Synthesis Example 2 with a solid content of 30 wt. %, 5 parts by weight of 1,4-butanediol dimethacrylate, 10 parts by weight of the CTM No. 11, 0.1 parts by weight of benzoyl peroxide and 30 parts by weight of toluene were mixed to prepare a coating liquid for a charge transport layer. The thus prepared liquid was coated on the above prepared charge generation layer by a doctor blade, and dried and thermoset at 150° C. for 30 minutes, so that a charge transport layer with a thickness of 23 μm was formed on the charge generation layer. Thus, an electrophotographic photoconductor of the present invention was obtained.

EXAMPLE 3

An intermediate layer and a charge generation layer were successively formed on a substrate in the same manner as in Example 1.

[Formation of Charge Transport Layer]

20 parts by weight of the acrylic resin synthesized in Synthesis Example 3 with a solid content of 30 wt. %, 6 parts by weight of 1,3-butanediol dimethacrylate, 10 parts by weight of the CTM No. 32, 0.1 parts by weight of benzoyl peroxide and 30 parts by weight of toluene were mixed to prepare a coating liquid for a charge transport layer. The thus prepared liquid was coated on the above prepared charge generation layer by a doctor blade, and dried and thermoset at 150° C. for 30 minutes, so that a charge transport layer with a thickness of 23 μm was formed on the charge generation layer. Thus, an electrophotographic photoconductor of the present invention was obtained.

EXAMPLE 4

An intermediate layer and a charge generation layer were successively formed on a substrate in the same manner as in Example 1.

[Formation of Charge Transport Layer]

20 parts by weight of the acrylic resin synthesized in Synthesis Example 4 with a solid content of 30 wt. %, 3 parts by weight of 1,3-butanediol dimethacrylate, 10 parts by weight of the CTM No. 65, 0.1 parts by weight of Michler's ketone and 20 parts by weight of toluene were mixed to prepare a coating liquid for a charge transport layer. The thus prepared liquid was coated on the above prepared charge generation layer by a doctor blade, and dried at 120° C. for 10 minutes. The coated surface was then subjected to photo-setting by use of the same photo-setting apparatus under the same conditions as in Example 1.

Thus, a charge transport layer with a thickness of 25 μm was formed on the charge generation layer, and an electrophotographic photoconductor of the present invention was obtained.

EXAMPLE 5

An intermediate layer and a charge generation layer were successively formed on a substrate in the same manner as in Example 1.

[Formation of Charge Transport Layer]

7 parts by weight of a commercially available polyester resin "U Polymer" (Trademark), made by Unitika Ltd., 4 parts by weight of diallyl isophthalate, 12 parts by weight of the CTM No. 95, 0.1 parts by weight of Michler's ketone, 60 parts by weight of tetrahydrofuran and 0.001 parts by weight of a commercially available silicone oil "KF-50" (Trademark), made by Shin-Etsu Chemical Co., Ltd., were mixed to prepare a coating liquid for a charge transport layer. The thus prepared liquid was coated on the above prepared charge generation layer by a doctor blade, and dried at 120° C. for 10 minutes. The coated surface was then subjected to photo-setting by use of the same photo-setting apparatus under the same conditions as in Example 1.

Thus, a charge transport layer with a thickness of 23 μm was formed on the charge generation layer, and an electrophotographic photoconductor of the present invention was obtained.

EXAMPLE 6

An intermediate layer and a charge generation layer were successively formed on a substrate in the same manner as in Example 1.

[Formation of Charge Transport Layer]

7 parts by weight of a commercially available polycarbonate resin "C-1400" (Trademark), made by Teijin Limited., 4 parts by weight of 4,4'-methacryloxyisopropylidenediphenyl, 12 parts by weight of the CTM No. 15, 0.1 parts by weight of benzoyl peroxide, 60 parts by weight of tetrahydrofuran and 0.001 parts by weight of a commercially available silicone oil "KF-50" (Trademark), made by Shin-Etsu Chemical Co., Ltd., were mixed to prepare a coating liquid for a charge transport layer. The thus prepared liquid was coated on the above prepared charge generation layer by a doctor blade, and dried and thermoset at 150° C. for 30 minutes, so that a charge transport layer with a thickness of 25 μm was formed on the charge generation layer. Thus, an electrophotographic photoconductor of the present invention was obtained.

EXAMPLE 7

[Formation of Intermediate Layer]

A mixture of the following components was dispersed to prepare a coating liquid for an intermediate layer:

| | Parts by Weight |
|---|---|
| Titanium oxide "Tipaque" (Trademark), made by Ishihara Sangyo Kaisha, Ltd. | 30 |
| Polyamide resin "CM-8000" (Trademark), made by Toray Industries, Inc. | 30 |
| Methanol | 100 |

The thus obtained coating liquid for the intermediate layer was coated on an aluminum sheet with a thickness of 0.3 mm serving as an electroconductive substrate by a doctor blade, and dried at 120° C. for 20 minutes, so that an intermediate layer with a thickness of 2 μm was formed on the substrate.

[Formation of Charge Generation Layer]

A mixture of the following components was dispersed to prepare a coating liquid for a charge generation layer:

| | Parts by Weight |
|---|---|
| Compound represented by the following Formula X: | |
| [Formula X] | 20 |

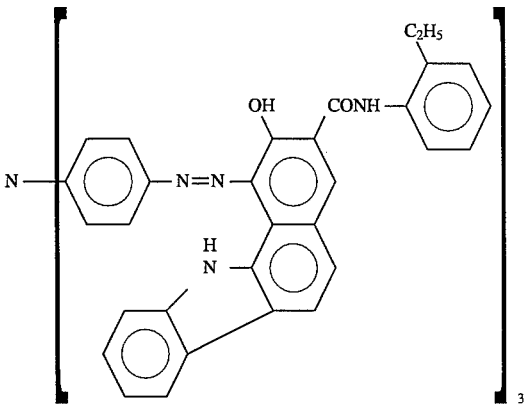

| | |
|---|---|
| Epoxy resin "PKHH" (Trademark), made by Union Carbide Japan K.K. | 20 |
| Cyclohexanone | 100 |

The thus obtained coating liquid for the charge generation layer was coated on the above prepared intermediate layer by a doctor blade, and dried at 120° C. for 10 minutes, so that a charge generation layer with a thickness of 0.2 μm was formed on the intermediate layer.

[Formation of Charge Transport Layer]

The same procedure for forming the charge transport layer as in Example 2 was repeated, so that a charge transport layer with a thickness of 23 μm was formed on the charge generation layer. Thus, an electrophotographic photoconductor of the present invention was obtained.

Synthesis Example 5

A stirrer, an ester tube, a condenser, a nitrogen-introducing tube, and a thermometer were attached to a 200-ml separable flask. 35.0 g of propylene glycol and 33.2 g of isophthalic acid were placed in the flask, and the mixture was heated to 180° to 190° C. to carry out the reaction, with water generated in the course of the reaction being removed from the mixture through the ester tube. The temperature of the reaction mixture was lowered to 100° C. when the acid value of the mixture was 27.0. With the addition of 23.2 g of fumaric acid and 0.1 g of hydroquinone, the temperature of the reaction mixture was again heated to 180° to 190° C. and the reaction was continued until the acid value reached 9.0. Thus, an unsaturated polyester resin having the double bond of carbon atoms on the main chain thereof for use in the present invention was obtained.

Synthesis Example 6

A stirrer, a nitrogen-introducing tube, a thermometer and a gas-chromatography-cap were attached to a 100-ml four-necked flask. 20 ml of methylene chloride, 15.3 g of styrene and 5.1 g of styryl methacrylate were placed in the flask in a stream of nitrogen, and the temperature of the mixture was lowered to −78° C.

With the addition of 2.0 ml of boron trifluoride diethyl etherate with a syringe, the polymerization reaction of the mixture was initiated. After the polymerization reaction was carried out for 6 hours, the reaction mixture was placed in 2 l of methanol to separate a desired polymer as a white precipitate.

Thus, a polystyrene resin having the double bond of carbon atoms on the side chain thereof for use in the present invention was obtained.

EXAMPLE 8

An intermediate layer and a charge generation layer were successively formed on a substrate in the same manner as in Example 1.

[Formation of Charge Transport Layer]

10 parts by weight of a 20% toluene solution containing the unsaturated polyester resin synthesized in Synthesis Example 5, 1.8 parts by weight of the CTM No. 37, 0.05 parts by weight of methyl ethyl ketone peroxide, and 10 parts by weight of toluene were mixed to prepare a coating liquid for a charge transport layer. The thus prepared liquid was coated on the above prepared charge generation layer by a doctor blade, and dried at 50° C. for 10 minutes, and then thermoset at 130° C. for 30 minutes, so that a charge transport layer with a thickness of 25 μm was formed on the charge generation layer. Thus, an electrophotographic photoconductor of the present invention was obtained.

EXAMPLE 9

An intermediate layer and a charge generation layer were successively formed on a substrate in the same manner as in Example 7.

[Formation of Charge Transport Layer]

10 parts by weight of a 20% toluene solution containing the unsaturated polyester resin synthesized in Synthesis Example 5, 2 parts by weight of the CTM No. 96, 0.05 parts by weight of methyl ethyl ketone peroxide, and 10 parts by weight of toluene were mixed to prepare a coating liquid for a charge transport layer. The thus prepared liquid was coated on the above prepared charge generation layer by a doctor blade, and dried at 50° C. for 10 minutes, and then thermoset at 130° C. for 30 minutes, so that a charge transport layer with a thickness of 25 μm was formed on the charge generation layer. Thus, an electrophotographic photoconductor of the present invention was obtained.

EXAMPLE 10

An intermediate layer and a charge generation layer were successively formed on a substrate in the same manner as in Example 1.

[Formation of Charge Transport Layer]

3 parts by weight of the polystyrene resin synthesized in Synthesis Example 6, 2.7 parts by weight of the CTM No. 4, 0.05 parts by weight of methyl ethyl ketone peroxide, and 10 parts by weight of toluene were mixed to prepare a coating liquid for a charge transport layer. The thus prepared liquid was coated on the above prepared charge generation layer by a doctor blade, and dried at 50° C. for 10 minutes, and then thermoset at 130° C. for 30 minutes, so that a charge transport layer with a thickness of 27 μm was formed on the charge generation layer. Thus, an electrophotographic photoconductor of the present invention was obtained.

EXAMPLE 11

All intermediate layer and a charge generation layer were successively formed on a substrate in the same manner as in Example 1.

[Formation of Charge Transport Layer]

3 parts by weight of the polystyrene resin synthesized in Synthesis Example 6, 2.7 parts by weight of the CTM No. 72, 0.05 parts by weight of Michler's ketone, and 10 parts by weight of toluene were mixed to prepare a coating liquid for a charge transport layer. The thus prepared liquid was coated on the above prepared charge generation layer by a doctor blade, and dried at 120° C. for 10 minutes. The coated surface was then subjected to photo-setting by use of the same photo-setting apparatus under the same conditions as in Example 1.

Thus, a charge transport layer with a thickness of 25 μm was formed on the charge generation layer, and an electrophotographic photoconductor of the present invention was obtained.

EXAMPLE 12

An intermediate layer and a charge generation layer were successively formed on a substrate in the same manner as in Example 1.

[Formation of Charge Transport Layer]

35 parts by weight of a 20% toluene solution containing the unsaturated polyester resin synthesized in Synthesis Example 5, 3 parts by weight of "Viscoat #3700" (Trademark), made by Osaka Organic Chemical Industry Ltd., represented by general formula XI, 10 parts by weight of the CTM No. 51, 0.05 parts by weight of methyl ethyl ketone peroxide, and 10 parts by weight of toluene were mixed to prepare a coating liquid for a charge transport layer. The thus prepared liquid was coated on the above prepared charge generation layer by a doctor blade, and dried at 50° C. for 10 minutes, and then thermoset at 130° C. for 30 minutes, so that a charge transport layer with a thickness of 28 μm was formed on the charge generation layer. Thus, an electrophotographic photoconductor of the present invention was obtained.

Viscoat #3700 with a viscosity of 400 to 600 cPs/50° C.

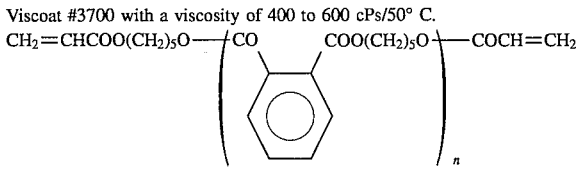

[Formula XI]

EXAMPLE 13

The procedure for preparation of the electrophotographic photoconductor in Example 12 was repeated except that "Viscoat #3700" (Trademark), made by Osaka Organic Chemical Industry Ltd., for use in the coating liquid for the charge transport layer was replaced by "Viscoat #540" (Trademark) represented by the following general formula XII:

Viscoat #540 with a viscosity of $2 \times 10^4$ cPs/50° C.

[Formula XII]

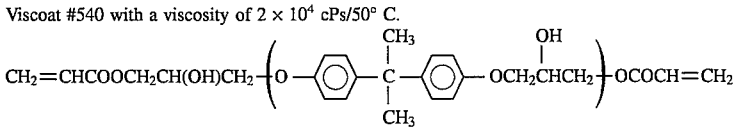

Thus, an electrophotographic photoconductor of the present invention was obtained.

EXAMPLE 14

An intermediate layer and a charge generation layer were successively formed on a substrate in the same manner as in Example 1.

[Formation of Charge Transport Layer]

35 parts by weight of a 20% toluene solution containing the unsaturated polyester resin synthesized in Synthesis Example 5, 3 parts by weight of 1,6-hexanediol methacrylate, 0.1 parts by weight of Michler's ketone, 10 parts by weight of the CTM No. 101, and 20 parts by weight of toluene were mixed to prepare a coating liquid for a charge transport layer. The thus prepared liquid was coated on the above prepared charge generation layer by a doctor blade, and dried at 120° C. for 10 minutes. The coated surface was then subjected to photo-setting by use of the same photo-setting apparatus under the same conditions as in Example 1.

Thus, a charge transport layer with a thickness of 26 μm was formed on the charge generation layer, and an electrophotographic photoconductor of the present invention was obtained.

EXAMPLE 15

An intermediate layer and a charge generation layer were successively formed on a substrate in the same manner as in Example 1.

[Formation of Charge Transport Layer]

7 parts by weight of the polystyrene resin synthesized in Synthesis Example 6, 3 parts by weight of 1,6-hexanediol methacrylate, 0.1 parts by weight of Michler's ketone, 10 parts by weight of the CTM No. 4, and 20 parts by weight of toluene were mixed to prepare a coating liquid for a charge transport layer. The thus prepared liquid was coated on the above prepared charge generation layer by a doctor blade, and dried at 120° C. for 10 minutes. The coated surface was then subjected to photo-setting by use of the same photo-setting apparatus under the same conditions as in Example 1.

Thus, a charge transport layer with a thickness of 20 μm was formed on the charge generation layer, and an electrophotographic photoconductor of the present invention was obtained.

Comparative Example 1

An intermediate layer and a charge generation layer were successively formed on a substrate in the same manner as in Example 1.

[Formation of Charge Transport Layer]

The following components were mixed to prepare a coating liquid for a charge transport layer:

| | Parts by Weight |
|---|---|
| Compound of formula XIII 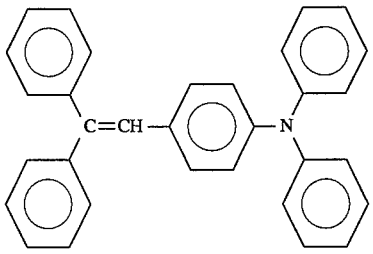 | 9 |
| Polycarbonate resin "C-1400" (Trademark), made by Teijin Limited. | 10 |
| Silicone oil "KF-50" (Trademark), made by Shin-Etsu Chemical Co., Ltd. | 0.001 |
| Methylene chloride | 90 |

The thus prepared liquid was coated on the above prepared charge generation layer by a doctor blade, and dried at 120° C. for 20 minutes, so that a charge transport layer with a thickness of 23 μm was formed on the charge generation layer. Thus, a comparative electrophotographic photoconductor was obtained.

Comparative Example 2

The procedure for preparation of the comparative electrophotographic photoconductor in Comparative Example 1 was repeated except that the polycarbonate resin "C-1400" (Trademark), made by Teijin Limited., for use in the coating liquid for the charge transport layer was replaced by Z type polycarbonate. Thus, a comparative electrophotographic photoconductor was obtained.

Each of the thus prepared electrophotographic photoconductors according to the present invention was subjected to the electrophotographic property evaluation test using a commercially available electrostatic copying sheet testing apparatus ("Paper Analyzer Model SP-428" made by Kawaguchi Electro Works Co., Ltd.) in the dynamic mode.

Each photoconductor was charged under application of −6 kV of corona charge for 20 seconds, and the surface potential Vm (volt) of the photoconductor was measured. Then, each electrophotographic photoconductor was allowed to stand in the dark for 20 seconds without applying any charge thereto, and the surface potential Vo (volt) of the photoconductor was measured. The dark decay ratio was calculated in accordance with the formula of Vo/Vm. Each photoconductor was then illuminated by a tungsten white lamp in such a manner that the illuminance on the surface of the photoconductor was 4.5 lux, and the exposure $E_{1/2}$ (lux.sec) and $E_{1/10}$ (lux.sec) required to reduce the initial surface potential Vo to respectively ½ and 1/10 thereof were measured. The surface potential Vr (volt) of the photoconductor which was obtained 30 seconds after the application of tungsten white light was also measured. The results are shown in Table 2.

In addition to the above, each photoconductor was subjected to a pencil hardness test using a commercially available surface profile measuring apparatus "HEIDON-14" (Trademark), made by Shinto Scientific Corporation Ltd., with a load of 100 g applied to the surface of each photoconductor.

Furthermore, Vickers hardness test was carried out in such a fashion that a pyramid indenter was indented into the surface of each photoconductor with the application of a load of 25 g.

An abrasion test was further conducted, using a commercially available "Rotary Abrasion Tester", made by Toyo Seiki Seisaku-sho, Ltd., with a truck wheel of $CS_{-10}$. The abrasion wear was measured after each sample of the photoconductor was rotated 2000 times with a load of 310 g.

The results of the above-mentioned tests are given in Table 3.

TABLE 2

| Example No. | Vm (V) | Vo/Vm | $E_{1/2}$ | $E_{1/10}$ | Vr |
|---|---|---|---|---|---|
| 1 | 1540 | 0.92 | 2.35 | 6.72 | 8 |
| 2 | 1380 | 0.85 | 1.49 | 4.67 | 5 |
| 3 | 1250 | 0.88 | 2.46 | 5.23 | 5 |
| 4 | 1440 | 0.90 | 3.08 | 7.41 | 10 |
| 5 | 1550 | 0.91 | 4.75 | 11.48 | 15 |
| 6 | 1580 | 0.96 | 4.92 | 12.18 | 18 |
| 7 | 1120 | 0.79 | 1.85 | 5.06 | 8 |
| 8 | 1550 | 0.89 | 2.48 | 5.72 | 5 |
| 9 | 1490 | 0.83 | 3.59 | 7.46 | 12 |
| 10 | 1600 | 0.91 | 3.95 | 8.35 | 10 |
| 11 | 1270 | 0.83 | 2.08 | 4.18 | 3 |
| 12 | 1370 | 0.82 | 2.41 | 5.52 | 8 |
| 13 | 1480 | 0.93 | 3.04 | 7.08 | 6 |
| 14 | 1540 | 0.95 | 3.08 | 7.12 | 8 |
| 15 | 1740 | 0.87 | 3.14 | 7.31 | 12 |
| Comp. Ex. 1 | 1280 | 0.87 | 1.04 | 2.08 | 0 |
| Comp. Ex. 2 | 1340 | 0.90 | 1.08 | 2.12 | 0 |

TABLE 3

| Example No. | Pencil Hardness | Vickers Hardness | Abrasion Wear (mg) |
|---|---|---|---|
| 1 | 4H | 35.0 | 0.8 |
| 2 | 3H | 32.5 | 0.7 |
| 3 | 5H | 40.4 | 0.5 |
| 4 | 4H | 30.8 | 1.2 |
| 5 | 3H | 33.8 | 1.0 |
| 6 | 4H | 31.9 | 0.9 |
| 7 | 3H | 32.7 | 0.6 |

TABLE 3-continued

| Example No. | Pencil Hardness | Vickers Hardness | Abrasion Wear (mg) |
|---|---|---|---|
| 8 | 4H | 35.6 | 0.5 |
| 9 | 5H | 40.8 | 0.6 |
| 10 | 6H | 45.0 | 0.3 |
| 11 | 5H | 41.0 | 0.5 |
| 12 | 6H | 46.2 | 0.3 |
| 13 | 5H | 39.8 | 0.8 |
| 14 | 6H | 40.5 | 0.8 |
| 15 | 6H | 47.0 | 0.4 |
| Comp. Ex. 1 | B | 21.0 | 12.3 |
| Comp. Ex. 2 | H | 24.5 | 15.5 |

EXAMPLE 16

[Formation of Intermediate Layer]

The following components were mixed to prepare a coating liquid for an intermediate layer:

| | Parts by Weight |
|---|---|
| Polyamide resin "CM-8000" (Trademark), made by Toray Silicone Co., Ltd. | 0.4 |
| Methanol | 6 |
| Butanol | 3.6 |

The above prepared coating liquid for the intermediate layer was coated on an aluminum cylinder with a diameter of 80 mm and a length of 340 mm, serving as an electroconductive substrate, by the dip coating method and then dried, so that an intermediate layer with a thickness of 0.3 μm was formed on the substrate.

[Formation of Charge Generation Layer]

A mixture of 2.2 parts by weight of a compound represented by general formula XIV and 44 parts by weight of cyclohexanone was pulverized and dispersed in a ball mill for 72 hours.

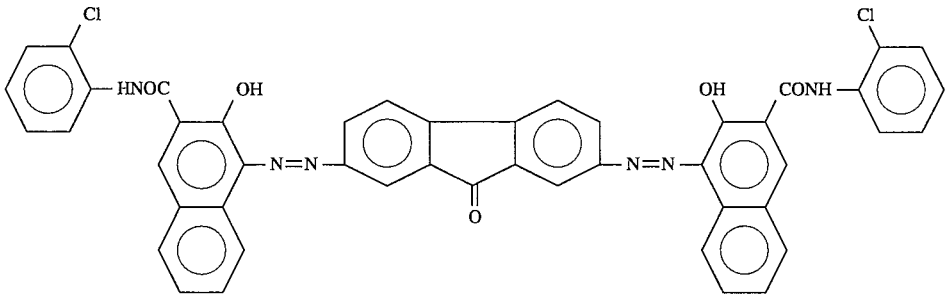

[Formula XIV]

With the addition of 60 parts by weight of cyclohexanone, the above mixture was further dispersed in the ball mill for 3 hours, and then diluted with 80 parts by weight of a mixed solvent of cyclohexanone and methyl ethyl ketone with a weight ratio of 1:1. Thus, a coating liquid for a charge generation layer was prepared. This coating liquid was coated on the above prepared intermediate layer by the dip coating method and dried at 120° C. for 10 minutes, so that a charge generation layer with a thickness of 0.3 μm was formed on the intermediate layer.

[Formation of Charge Transport Layer]

The following components were mixed to prepare a coating liquid for a charge transport layer:

| | Parts by Weight |
|---|---|
| Acrylic resin synthesized in Synthesis Example 1 (solid content: 30 wt. %) | 20 |
| 1,6-hexanediol methacrylate | 4 |
| CTM No. 3 | 9 |
| Michler's ketone | 0.1 |
| Toluene | 30 |

This coating liquid for the charge transport layer was coated on the above prepared charge generation layer by the dip coating method, and dried at 120° C. for 10 minutes.

Figure 2:
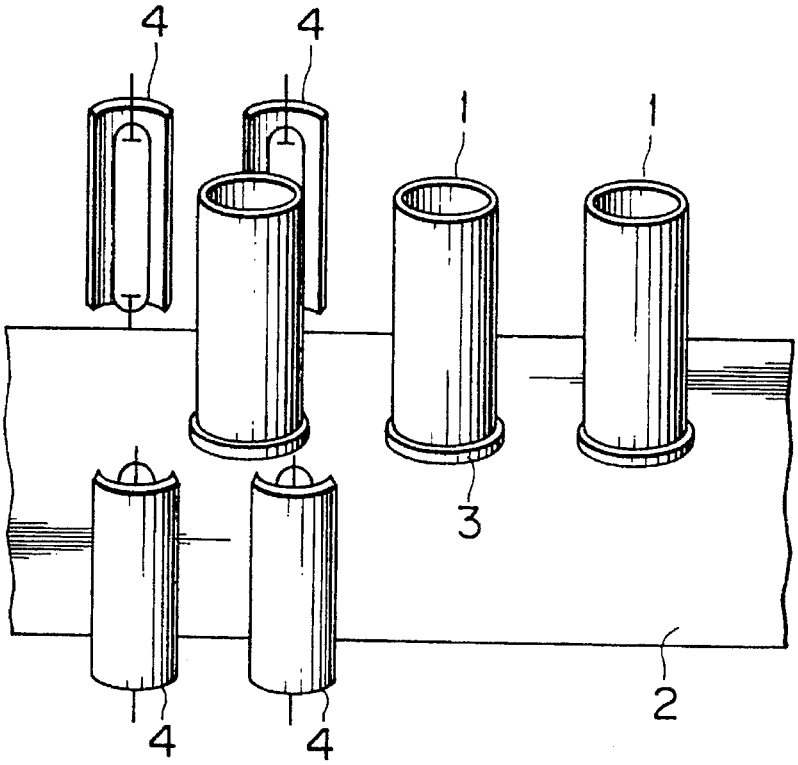
FIG. 2 is a schematic perspective view showing a part of the apparatus shown in FIG. 1.

The coated surface was subjected to photo-setting using a photo-setting apparatus as shown in FIG. 1 and FIG. 2. As shown in FIG. 1, a photoconductive drum 1 was set on a drum fixing table 3 located on a belt conveyor 2. The photoconductive drum 1 set on the belt conveyor 2 was driven to move at a speed of 1 m/min, and entered a lamp house 5, with the drum fixing table 3 being rotated at 10 rpm. In the lamp house 5, as shown in FIG. 2, four mercury vapor lamps 4, each having a light volume of 120 W/cm, were situated 10 cm apart from the photoconductive drum 1 which was sent along the belt conveyor 2. The surface of the charge transport layer of each photoconductive drum 1 was subjected to photo-setting by use of four mercury vapor lamps 4, and after the completion of photo-setting, the photoconductive drum was removed with an arm 6 as shown in FIG. 1.

Thus, a charge transport layer with a thickness of 27 μm was formed on the charge generation layer, and an electrophotographic photoconductor of the present invention was obtained.

EXAMPLE 17

An intermediate layer and a charge generation layer were successively formed on an aluminum substrate in the same manner as in Example 16.

[Formation of Charge Transport Layer]

The following components were mixed to prepare a coating liquid for a charge transport layer:

| | Parts by Weight |
|---|---|
| Acrylic resin synthesized in Synthesis Example 2 (solid content: 30 wt. %) | 20 |
| 1,4-butanediol methacrylate | 5 |
| CTM No. 11 | 10 |
| Benzoyl peroxide | 0.1 |
| Toluene | 30 |

This coating liquid for the charge transport layer was coated on the above prepared charge generation layer by the dip coating method, and dried and thermoset at 150° C. for 30 minutes, so that a charge transport layer with a thickness of 25 μm was formed on the charge generation layer. Thus, an electrophotographic photoconductor of the present invention was obtained.

EXAMPLE 18

An intermediate layer and a charge generation layer were successively formed on an aluminum substrate in the same manner as in Example 16.

[Formation of Charge Transport Layer]

The following components were mixed to prepare a coating liquid for a charge transport layer:

| | Parts by Weight |
|---|---|
| Acrylic resin synthesized in Synthesis Example 3 (solid content: 30 wt. %) | 20 |
| 1,3-butanediol methacrylate | 6 |
| CTM No. 32 | 10 |
| Benzoyl peroxide | 0.1 |
| Toluene | 30 |

This coating liquid for the charge transport layer was coated on the above prepared charge generation layer by the dip coating method, and dried and thermoset at 150° C. for 30 minutes, so that a charge transport layer with a thickness of 25 μm was formed on the charge generation layer. Thus, an electrophotographic photoconductor of the present invention was obtained.

EXAMPLE 19

An intermediate layer and a charge generation layer were successively formed on an aluminum substrate in the same manner as in Example 16.

[Formation of Charge Transport Layer]

The following components were mixed to prepare a coating liquid for a charge transport layer:

| | Parts by Weight |
|---|---|
| Polyester resin "U Polymer" (Trademark), made by Unitika Ltd. | 7 |
| Diallyl isophthalate | 4 |
| CTM No. 95 | 12 |
| Silicone oil "KF-50" (Trademark), made by Shin-Etsu Chemical Co., Ltd. | 0.001 |
| Tetrahydrofuran | 60 |

This coating liquid for the charge transport layer was coated on the above prepared charge generation layer by the dip coating method, and dried at 120° C. for 30 minutes. The coated surface was subjected to photo-setting by use of the same photo-setting apparatus under the same conditions as in Example 16, so that a charge transport layer with a thickness of 23 μm was formed on the charge generation layer. Thus, an electrophotographic photoconductor of the present invention was obtained.

EXAMPLE 20

An intermediate layer and a charge generation layer were successively formed on an aluminum substrate in the same manner as in Example 16.

[Formation of Charge Transport Layer]

The following components were mixed to prepare a coating liquid for a charge transport layer:

| | Parts by Weight |
|---|---|
| Polyester resin synthesized in Synthesis Example 5 | 10 |
| CTM No. 37 | 12 |
| Methyl ethyl ketone peroxide | 0.1 |
| Toluene | 80 |

This coating liquid for the charge transport layer was coated on the above prepared charge generation layer by the dip coating method, and dried and thermoset at 130° C. for 30 minutes, so that a charge transport layer with a thickness of 25 μm was formed on the charge generation layer. Thus, an electrophotographic photoconductor of the present invention was obtained.

EXAMPLE 21

An intermediate layer and a charge generation layer were successively formed on an aluminum substrate in the same manner as in Example 16.

[Formation of Charge Transport Layer]

The following components were mixed to prepare a coating liquid for a charge transport layer:

| | Parts by Weight |
|---|---|
| Polystyrene resins synthesized in Synthesis Example 6 | 10 |
| CTM No. 84 | 12 |
| Methyl ethyl ketone peroxide | 0.1 |
| Toluene | 60 |

This coating liquid for the charge transport layer was coated on the above prepared charge generation layer by the dip coating method, and dried and thermoset at 130° C. for 30 minutes, so that a charge transport layer with a thickness of 26 μm was formed on the charge generation layer. Thus, an electrophotographic photoconductor of the present invention was obtained.

EXAMPLE 22

An intermediate layer and a charge generation layer were successively formed on an aluminum substrate in the same manner as in Example 16.

[Formation of Charge Transport Layer]

The following components were mixed to prepare a coating liquid for a charge transport layer:

| | Parts by Weight |
|---|---|
| Polyester resin synthesized in Synthesis Example 5 | 5 |
| "Viscoat #3700" (Trademark), made by Osaka Organic Chemical Industry Ltd. | 5 |
| CTM No. 42 | 12 |
| Michler's ketone | 0.1 |
| Toluene | 80 |

This coating liquid for the charge transport layer was coated on the above prepared charge generation layer by the dip coating method, and dried at 120° C. for 10 minutes. The coated surface was subjected to photo-setting by use of the same photo-setting apparatus under the same conditions as in Example 16, so that a charge transport layer with a thickness of 25 μm was formed on the charge generation layer. Thus, an electrophotographic photoconductor of the present invention was obtained.

Comparative Example 3

An intermediate layer and a charge generation layer were successively formed on an aluminum substrate in the same manner as in Example 16.

[Formation of Charge Transport Layer]

The following components were mixed to prepare a coating liquid for a charge transport layer:

| | Parts by Weight |
|---|---|
| Compound represented by the following formula XV: | |
| 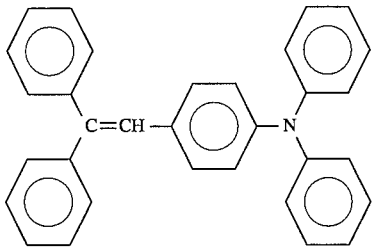 | 9 |
| Polycarbonate resin "C-1400" (Trademark), made by Teijin Limited. | 10 |
| Silicone oil "KF-50" (Trademark), made by Shin-Etsu Chemical Co., Ltd. | 0.001 |
| Dichloromethane | 70 |

This coating liquid for the charge transport layer was coated on the above prepared charge generation layer by the dip coating method, and dried at 130° C. for 20 minutes, so that a charge transport layer with a thickness of 25 μm was formed on the charge generation layer. Thus, a comparative electrophotographic photoconductor was obtained.

Comparative Example 4

The procedure for preparation of the comparative electrophotographic photoconductor in Comparative Example 3 was repeated except that the formulation for the charge transport layer coating liquid used in Comparative Example 3 was replaced by that in Comparative Example 2, so that a comparative electrophotographic photoconductor was obtained.

Each of the thus obtained electrophotographic photoconductors according to the present invention obtained in Examples 16 to 22 and the comparative photoconductors obtained in Comparative Examples 3 and 4 was set in a commercially available copying machine "FT-4820" (Trademark), made by Ricoh Company, Ltd., and 100,000 copies were made to evaluate the durability of each photoconductor. In this durability test, the initial potential at a dark portion on the surface of the photoconductor was set to 800 V and the initial potential at a portion to which the light was applied was set to 80 V. The potential at the dark portion (VD) and the potential at the portion to which the light was applied (VL) were measured after making of 100,000 copies. Table 4 shows the degree of change in both potentials (VD) and (VL).

In addition, each photoconductor was subjected to the same abrasion test as previously described, and the depth of wear was measured. The results of the abrasion test are also given in Table 4.

TABLE 4

| | Durability Test | | Abrasion Test Depth of Wear |
|---|---|---|---|
| | VD | VL | (μm) |
| Example 16 | −20 | +20 | 1.5 |

TABLE 4-continued

| | Durability Test | | Abrasion Test Depth of Wear |
|---|---|---|---|
| | VD | VL | (μm) |
| Example 17 | −30 | +10 | 2.0 |
| Example 18 | −30 | +10 | 1.7 |
| Example 19 | −20 | +30 | 2.3 |
| Example 20 | −30 | +20 | 1.5 |
| Example 21 | −30 | +10 | 1.7 |
| Example 22 | −20 | +20 | 2.0 |
| Comp. Ex. 3 | −150 | +100 | 12.6 |
| Comp. Ex. 4 | −100 | +80 | 7.1 |

As is apparent from the results in Tables 2 to 4, the electrophotographic photoconductors according to the present invention are superior in the photosensitivity, the mechanical strength and the durability. More specifically, as can be seen from Table 4, the photoconductors of the present invention produced clear images after making of 100,000 copies as well as at the initial stage because of the improvement in wear resistance of the surface of the photoconductor. In contrast to this, since the abrasion wear of the surface of the comparative photoconductors was considerable, the potentials at the portions to which the light was applied (VL) were drastically changed after making of 100,000 copies. As a result, toner deposition on the background was observed and the density of a half tone image became uneven.

In addition, when the carbon-carbon double-bond-containing polymers for use in the present invention, for example, those synthesized in Synthesis Examples 5 and 6 are used in combination with a carbon-carbon double-bond-containing monomer or oligomer, the adhesion properties and the flexibility can be imparted to the obtained film of the charge transport layer, and the shrinkage of the film can be prevented in the course of curing.

What is claimed is:

1. An electrophotographic photoconductor, comprising an electroconductive substrate, and a photoconductive layer, which comprises a charge generation layer and a charge transport layer successively formed on said substrate in this order, said charge transport layer comprising a reaction product of i) a carbon-carbon double-bond-containing charge transport material and ii) a binder resin which comprises an unsaturated polyester, said components i) and ii) reacting with each other by the application of light or heat thereto.

2. The electrophotographic photoconductor as claimed in claim 1, wherein said binder resin further comprises a resin with a molecular weight of 8,000 to 100,000.

3. The electrophotographic photoconductor as claimed in claim 1, wherein said unsaturated polyester has a carbon-carbon double bond on a main chain or a side chain thereof.

4. The electrophotographic photoconductor as claimed in claim 1, wherein a ratio by weight of said carbon-carbon double-bond-containing charge transporting material to said unsaturated polyester is 1–60:10.

5. The electrophotographic photoconductor as claimed in claim 1, wherein said charge transport layer has a thickness of 10–50 μm.

6. The electrophotographic photoconductor as claimed in claim 1, wherein said charge generation layer has a thickness of 0.02–3 μm.

7. The electrophotographic photoconductor as claimed in claim 1, further comprising an intermediate layer which is provided between said substrate and said charge generation layer.

8. The electrophotographic photoconductor as claimed in claim 7, wherein said intermediate layer comprises a resin selected from the group consisting of polyamide, polyurethane, silicone resin, phenolic resin, polyvinyl alcohol, polyvinylbutyryl, polyacrylanilide and vinylchloride-vinylacetate-maleic acid copolymer.

9. The electrophotographic photoconductor as claimed in claim 8, wherein said intermediate layer further comprises particles of a pigment selected from the group consisting of $SiO_2$, $Al_2O_3$, ZnO, $TiO_2$, ZnS and $ZrO_2$ dispersed in said resin.

10. The electrophotographic photoconductor as claimed in claim 7, wherein said intermediate layer has a thickness of 0.05–20 μm.

* * * * *

UNITED STATES PATENT AND TRADEMARK OFFICE

CERTIFICATE OF CORRECTION

PATENT NO. : 5,496,671

DATED : MARCH 5, 1996

INVENTOR(S) : HIROSHI TAMURA, ET AL.

It is certified that error appears in the above-identified patent and that said Letters Patent is hereby corrected as shown below:

Column 5, line 32, "represent"

should read --represents--;

line 39, "represent"

should read --represents--;

line 44, "n" second occurrence, should read --n'--.

Column 41, line 14, "s-silicon"

should read --α-silicon--;

line 25 "is is"

should read --is--.

Signed and Sealed this

Seventeenth Day of March, 1998

*Attest:*

*Attesting Officer*

Bruce Lehman

BRUCE LEHMAN

*Commissioner of Patents and Trademarks*